US006531934B1

(12) United States Patent
Mikami et al.

(10) Patent No.: US 6,531,934 B1
(45) Date of Patent: Mar. 11, 2003

(54) DIELECTRIC RESONATOR, DIELECTRIC FILTER, DIELECTRIC DUPLEXER, OSCILLATOR, AND COMMUNICATION DEVICE

(75) Inventors: Shigeyuki Mikami, Nagaokakyo (JP); Toshiro Hiratsuka, Kusatsu (JP); Tomiya Sonoda, Muko (JP); Kiyoshi Kanagawa, Nagaokakyo (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/501,690

(22) Filed: Feb. 10, 2000

(30) Foreign Application Priority Data

Feb. 10, 1999 (JP) ..... 11-033189

(51) Int. Cl.[7] ..... H01P 7/10; H01P 1/203; H01P 1/208

(52) U.S. Cl. ..... 333/134; 333/219.1; 333/202

(58) Field of Search ..... 333/134, 219.1, 333/202, 206

(56) References Cited

U.S. PATENT DOCUMENTS 3,798,578 A * 3/1974 Konishi et al. ..... 333/219.1
5,859,574 A * 1/1999 Schmitt ..... 333/202
6,002,311 A * 12/1999 Wey et al. ..... 333/219.1

FOREIGN PATENT DOCUMENTS

| | | | | |
|---|---|---|---|---|
| EP | 0734088 A1 | | 9/1996 | ..... H01P/1/208 |
| EP | 0764996 A1 | | 3/1997 | ..... H01P/7/10 |
| EP | 0867965 A2 | | 9/1998 | ..... H01P/1/208 |
| EP | 0917231 A2 | | 5/1999 | ..... H01P/1/203 |
| EP | 0867965 A3 | | 10/1999 | ..... H01P/1/208 |
| EP | 0948077 A3 | | 10/1999 | ..... H01P/1/203 |
| EP | 0948077 A2 | | 10/1999 | ..... H01P/1/203 |
| EP | 0917231 A3 | | 12/2000 | ..... H01P/1/203 |
| JP | 7-142913 A | * | 6/1995 | ..... H01P/7/10 |
| JP | 0841714 A1 | * | 6/1997 | ..... H01P/7/10 |

OTHER PUBLICATIONS

European Search Report dated Jan. 14, 2002.

* cited by examiner

*Primary Examiner*—Robert Pascal
*Assistant Examiner*—Dean Takaoka
(74) *Attorney, Agent, or Firm*—Ostrolenk, Faber, Gerb & Soffen, LLP

(57) ABSTRACT

A dielectric filter comprises a dielectric substrate having two opposing main surfaces on which electrodes are formed. Electrodeless portions are formed in the electrodes on the two main surfaces. Conductors are arranged a fixed distance away from the dielectric substrate. The electrodes have projections and/or recesses formed in the boundary region between the electrodeless portion and the electrode.

20 Claims, 21 Drawing Sheets

DIELECTRIC RESONATOR, DIELECTRIC FILTER, DIELECTRIC DUPLEXER, OSCILLATOR, AND COMMUNICATION DEVICE

BACKGROUND OF THE INVENTION

1. Field of the Invention

The present invention relates to high-frequency electronic parts and particularly to a dielectric resonator to be used in microwave and millimeter wave bands and a dielectric filter, dielectric duplexer, oscillator, and communication device using such.

2. Description of the Related Art

A first example of a conventional dielectric filter is explained with reference to FIG. 26.

The dielectric filter 110*a* comprises a dielectric substrate 120*a* on the opposing upper and lower surfaces of which electrodes are arranged, a lower case 112, and an upper case 111. By removing part of the upper electrode five round electrodeless portions 121*a* through 121*e* are formed. In like manner, electrodeless portions 121*a'* through 121*e'* (not shown) of the same shape are formed at the corresponding locations of the lower electrode. A dielectric resonator 122*a* is composed of a dielectric substance between the electrodeless portions 121*a* and 121*a'* and the upper and lower cases 111 and 112 surrounding the substance. Other pairs of the electrodeless portions also constitute dielectric resonators likewise. The resonance frequency of each of the resonators depends on the shape of the electrodeless portions 121*a* through 121*e,* the thickness of the dielectric substrate 120*a,* etc.

The lower case 112 is made up of a substrate 113 and a metal frame 114 placed on the substrate. Inside the metal frame 114 a support 115 to support the dielectric substrate 120*a* is formed. On substantially the whole upper surface of the substrate 113 an electrode 116 is arranged. Part of the electrode 116 is removed, and in the electrodeless portion microstrip lines 130 and 131 are arranged. These lines function as input-output lines of the filter 110*a*. Further, on nearly the whole surface of the bottom of the substrate 113 an electrode 116' (not shown) is arranged.

In this filter, for example, the $TE_{010}$ resonance mode of each of the dielectric resonators is used. When a signal is input into the microstrip line 130, the microstrip line 130 and the dielectric resonator 122*a* are electromagnetically coupled. Further, through the coupling between the neighboring dielectric resonators 122*a* through 122*e* a signal is output from the microstrip line 131 on the output side. As a result, the dielectric filter 110*a* functions as a five-stage bandpass filter. The non-loaded Q of a dielectric resonator using the $TE_{010}$ mode is higher than the non-loaded Q of a dielectric resonator having a rectangular slot, which will be described later. For example, at 26 GHz the non-loaded Q of the former is about 1900 and the non-loaded Q of the latter is about 900. Thus, when $TE_{010}$ mode is used, non-loaded Q of the dielectric resonators is high, and accordingly there is an advantage of being able to obtain a dielectric filter with a small insertion loss.

Next, a second example of a conventional dielectric filters is explained with reference to FIG. 27.

In a dielectric filter 110*b,* the shape of the electrodeless portions 1121*f* through 1121*j* of the electrode is rectangular. The shape of the electrodeless portions on the lower surface of the substrate 1120*b* is the same. By making the shape of the electrodeless portions 1121*f* through 1121*j* rectangular, a rectangular slot mode is used as a resonance mode. For example, the $TE_{102}$ mode, which is a rectangular slot mode, can be used. When a rectangular slot mode is used, the amount of an electromagnetic field leaking outside the resonator increases, compared with the case where the $TE_{010}$ mode is used, and the degree of coupling between the input-output lines and the resonators and between the dielectric resonators 1122*f* through 1122*j* increases.

In the dielectric filter to be used in a communication device, a sufficient damping characteristic is required in the vicinity of a pass band. Generally, dielectric resonators constituting a dielectric filter have many resonance modes, and there are cases where the resonance frequencies of undesired resonance modes exist in the vicinity of the resonance frequencies of resonance modes to be used. In such cases, by changing the diameter of the resonators and the thickness of the dielectric substrate adjustment takes place so that the resonance frequencies of both modes are separated from each other. However, in the above conventional filters the separation of the resonance frequencies of both modes could not be effectively separated.

FIG. 28 shows the relationship between the resonance frequency and the resonator's diameter of the dielectric resonators contained in the dielectric filter 110*a*. The solid line represents the $TE_{010}$ mode as a resonance mode to be used, and the broken line the $HE_{310}$ mode which is an undesired resonance mode. Further, FIG. 29 shows the relationship of the resonance frequency to the resonator length (here, resonator length measured along the direction in which the plurality of resonators are arranged) in the dielectric filter 110*b*. The solid line represents the $TE_{102}$ mode as a resonance mode to be used, the broken line the $TM_{111}$ mode as an undesired resonance mode, and the one-dot chain line the $TM_{112}$ mode as another undesired resonance mode.

As understood in FIGS. 28 and 29, even if the sizes or shapes, etc., are changed in these dielectric resonators, the resonance frequency of an undesired resonance mode can not be so effectively separated from the resonance frequency of a resonance mode to be used.

SUMMARY OF THE INVENTION

According to the present invention, a dielectric resonator, dielectric filter, dielectric duplexer, oscillator, and communication device which have a good transmission characteristic or reflection characteristic are provided by separating the resonance frequency of an undesired resonance mode sufficiently far from the resonance frequency of a resonance mode to be used.

A dielectric resonator according to one aspect of the present invention comprises a dielectric substrate having two opposing two main surfaces, on which surface electrodes are formed. Electrodeless portions are formed in the surface electrodes, and a conductor is arranged a fixed distance away from the dielectric substrate. At least one electrode projection portion which projects into the electrodeless portion is provided in the boundary portion between the electrodeless portion and the electrode.

Further, a dielectric resonator according to a second aspect of the present invention comprises a dielectric substrate on the two opposing main surfaces on which surface electrodes are formed, electrodeless portions formed in the surface electrodes on the two main surfaces, and a conductor arranged a fixed distance away from the dielectric substrate, wherein at least one electrode recessed portion is formed in the surface electrode in the boundary portion between the electrodeless portion and the electrode.

Further, at least one projection portion and at least one recessed portion may be combined in a single dielectric resonator.

These projection and recessed portions can have an influence on the resonance frequencies of various resonance modes existing in a dielectric resonator and can separate the resonance frequencies of undesired resonance modes away from the resonance frequencies of resonance modes to be used.

Further, in a dielectric resonator of the present invention, the electrode projection portions can be arranged at fixed locations corresponding to undesired resonance modes in the dielectric resonator, respectively.

Further, in a dielectric resonator of the present invention, the recessed portions of electrode can be arranged at fixed locations corresponding to undesired resonance modes in the dielectric resonator, respectively.

These projection and recessed portions can change the resonance frequency of an undesired resonance mode most affecting the resonance mode to be used, that is, the undesired resonance mode having a resonance frequency closest to the resonance frequency of the resonance mode to be used. Further, by changing the location, shape, size, etc., of the electrode projection portion or recessed portion, the resonance frequency of an undesired resonance mode can be easily set.

Further, a dielectric filter of the present invention comprises the above dielectric resonator and an input-output connectors.

Further, a dielectric duplexer of the present invention comprises at least two dielectric filters, input-output connectors to be connected respectively to the dielectric filters, and an antenna connection means to be commonly connected to both dielectric filters, wherein at least one of the dielectric filters is composed of the above dielectric filter.

Further, a communication device of the present invention comprises the above dielectric duplexer, a transmission circuit to be connected to one of the input-output connectors of the dielectric duplexer, a reception circuit to be connected to the other input-output connector, and an antenna to be connected to the antenna connector of the dielectric duplexer.

Further, an oscillator of the present invention comprises the above dielectric resonator, an enclosure to contain the dielectric resonator, and a circuit board.

Further, another communication device of the present invention comprises at least a transmission circuit or a reception circuit, and/or an antenna, wherein the transmission circuit or reception circuit contains the above oscillator.

Because of the above features, a dielectric filter, dielectric duplexer, oscillator, and communication device having a good transmission characteristic or reflection characteristic can be obtained.

Other features and advantages of the invention will be understood from the following detailed description of embodiments thereof, wherein like references denote like elements and parts.

DESCRIPTION OF EMBODIMENTS OF THE INVENTION

Figure 1:
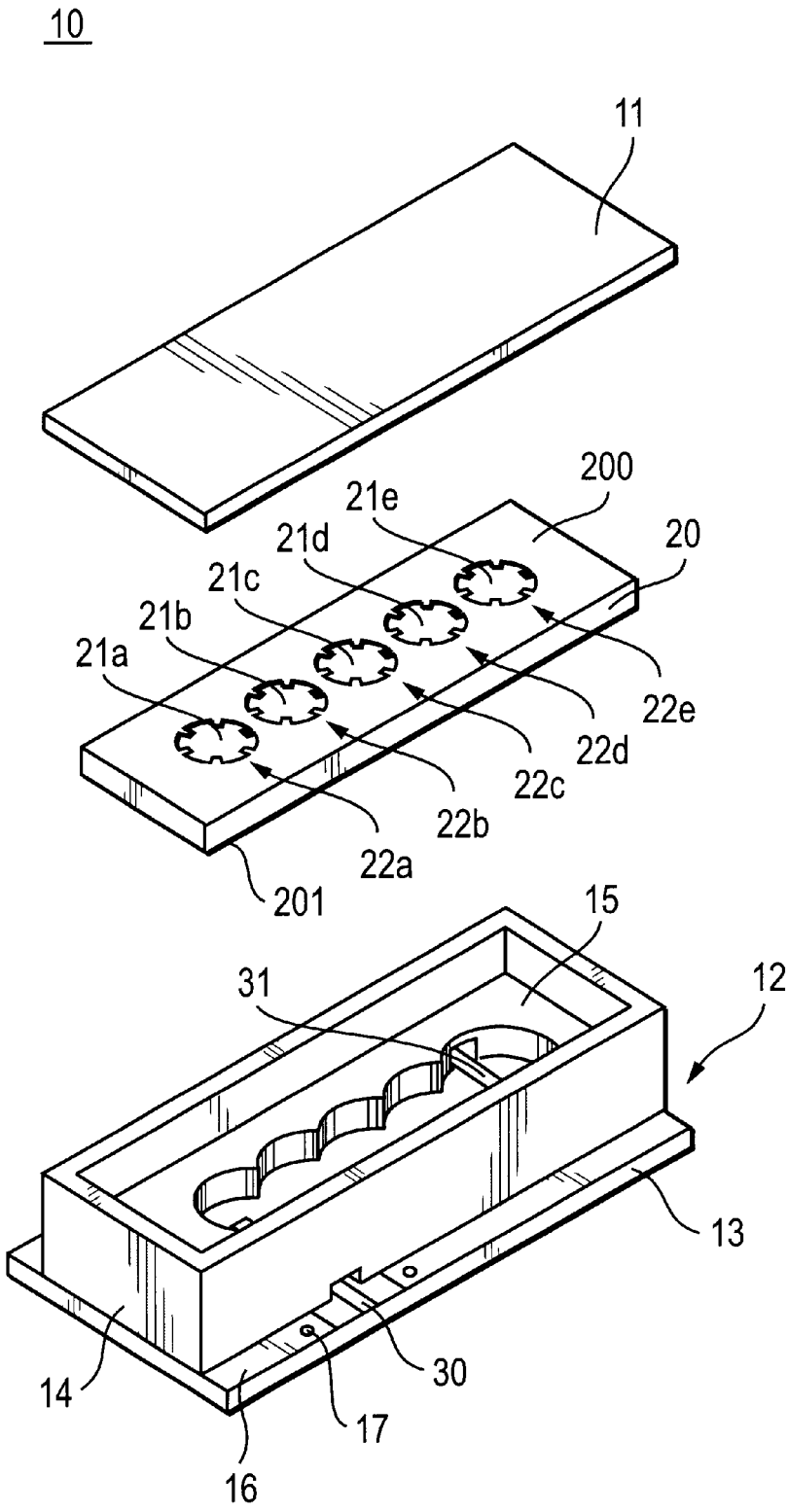
FIG. 1 is an exploded perspective view of a dielectric filter according to an embodiment of the present invention.

Hereinafter, a dielectric filter according to an embodiment of the present invention is explained with reference to FIG. 1.

The dielectric filter 10 is composed of a dielectric substrate 20 where electrodes 200 and 201 are arranged on the opposing upper and lower surfaces, a lower case 12, and an upper case 11. By removing part of the upper electrode, for example, five electrodeless portions 21*a* through 21*e* are formed. In like manner, electrodeless portions 21*a'* through 21*e'* (not illustrated) are formed at the corresponding locations of the lower electrode. The opposing electrodeless portions are preferably to have substantially the same shape in view of cost, but any respective shapes may be selected, if desired, in accordance with the use of the resonator. A dielectric substance between the electrodeless portions 21*a* and 21*a'* and the upper and lower cases 11 and 12 surrounding the substance constitutes a dielectric resonator 22*a*. Other pairs of electrodeless portions also constitute dielectric resonators likewise. The resonance frequency of each of the resonators can be freely adjusted, for example, by adjusting the shape of the electrodeless portions 21*a* through 21*e* and 21*a'* through 21*e'*, the thickness of the dielectric substrate 20, and so on.

The lower case 12 has a substrate 13 and a metal frame 14 placed on the substrate. Inside the metal frame 14 a support 15 to support the dielectric substrate 20 is formed. As long as the electrodes on the upper and lower surfaces of the substrate 20 are away from the upper case 11, the metal frame 14, and the electrode 16 on the upper surface of the substrate 13 and a space is provided above and below each of the resonators, a support of any shape can be accepted. It is desirable to form the electrode 16 on nearly the whole upper surface of the substrate 13, but the electrode can be properly changed in accordance with the shape of the support 15 and the size of the frame 14. Part of the electrode 16 is removed, and in the electrodeless portion microstrip lines 30 and 31 are arranged and function as input-output lines to the filter 10. Further, on nearly the whole bottom surface of the substrate 13 an electrode 16' (not illustrated) is arranged. Also, in order to suppress the generation of spurious modes, it is desirable to provide a through-hole 17 which conductively connects the electrodes 16 and 16'.

The upper surface of the support 15 and the electrode 201 are joined by a conductive adhesive, etc. And the upper case 11 is fixed on the upper surface of the frame 14 so as to cover the upper opening of the metal frame 14 of the lower case 12.

The above construction is but one example. In short, it is enough if opposing electrodeless portions are formed on the upper and lower surfaces of the substrate 20 and resonance cavities are formed around the electrodeless portions. When a signal is input to the microstrip line 30, the microstrip line 30 and the dielectric resonator 22*a* are electromagnetically coupled. Further, through the coupling between the neighboring dielectric resonators 22*a* through 22*e*, a signal is output from the microstrip line 31 on the output side. As a result, the dielectric filter 10 functions as a five-stage bandpass filter.

Figure 2:
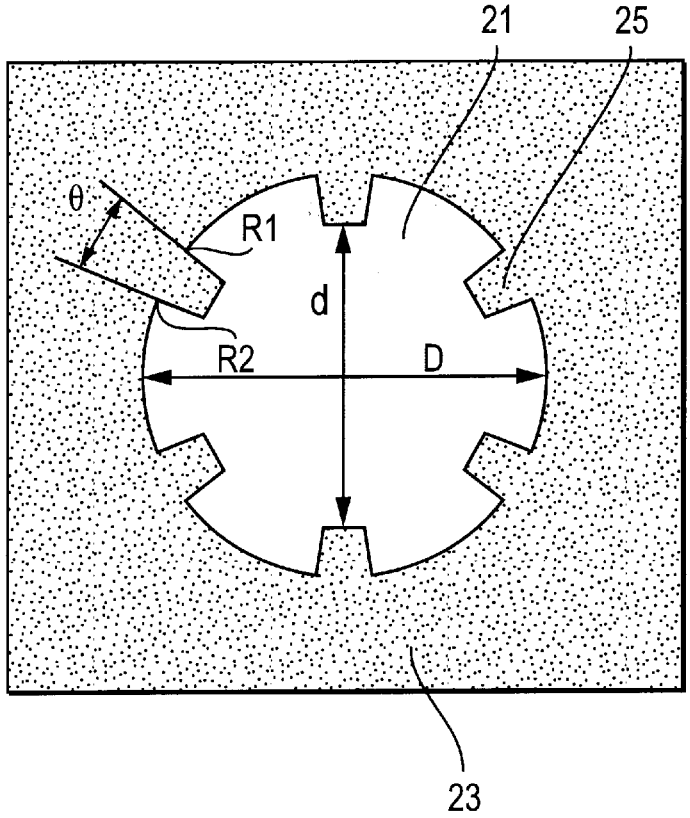
FIG. 2 is a top view of an electrodeless portion according to FIG. 1.

Next, a top view of an electrodeless portion 21, which corresponds to one of the electrodeless portions 21*a* through 21*e*, is shown in FIG. 2.

As shown in FIG. 2, the electrodeless portion desirably has a nearly round shape, defined in a electrode 23 which corresponds to the electrode 200 in FIG. 1, and, further, a plurality of electrodes 25 projecting inwardly from the periphery of the opening are desirable to be used. Most preferably, the angle between a line connecting one projection and the center of the opening and a line connecting a neighboring projection and the center of the opening is about 60 degrees. When the resonance mode to be used is the $TE_{010}$ mode, such a shape of the electrodeless portion is particularly effective to move the resonance frequency of an undesired mode away from the resonance frequency of the $TE_{010}$ mode.

Figure 3:
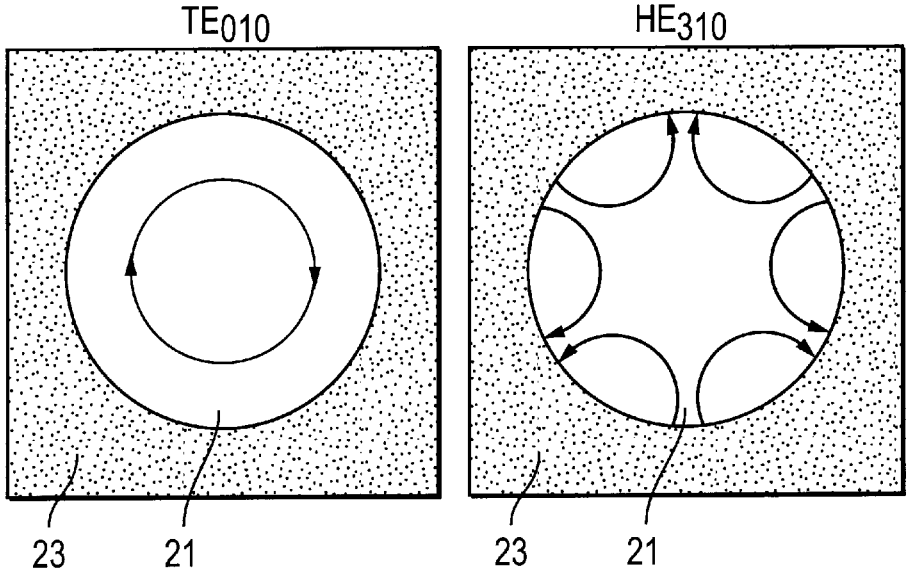
FIG. 3 shows the distribution of electric field concerning the $TE_{010}$ mode and $TE_{310}$ mode.

FIG. 3 shows the distribution of the electric field in the $TE_{010}$ mode that in the $HE_{310}$ mode, which is the undesired mode the resonance frequency of which is the closest to that of the $TE_{010}$ mode.

The $HE_{310}$ mode is a degenerated orthogonal double mode, and furthermore, another mode (not illustrated) exists. The distribution of electric field of the other mode (not illustrated) can be obtained by rotating the distribution of electric field, shown in FIG. 3, 90 degrees around the center of the opening. The projections arranged 60 degrees away from each other and the strong portion of the electric field strength of the $HE_{310}$ mode lie on top of another. As a result, the distribution of the electromagnetic field is perturbed by the projections, the degeneracy of $HE_{310}$ mode is lifted, and the degenerated $HE_{310}$ mode is split into the $HE_{310}$ plus mode and $HE_{310}$ minus mode. The resonance frequency of the $HE_{310}$ plus mode is higher than that of the $HE_{310}$ mode, and the resonance frequency of the $HE_{310}$ minus mode is lower than that of the $HE_{310}$ mode. As the resonance frequency of the $HE_{310}$ mode is very close to the resonance frequency of the $TE_{010}$ mode, the resonance frequency of an undesired mode and the resonance frequency of the $TE_{010}$ mode are separated because of the above splitting.

Figure 4:
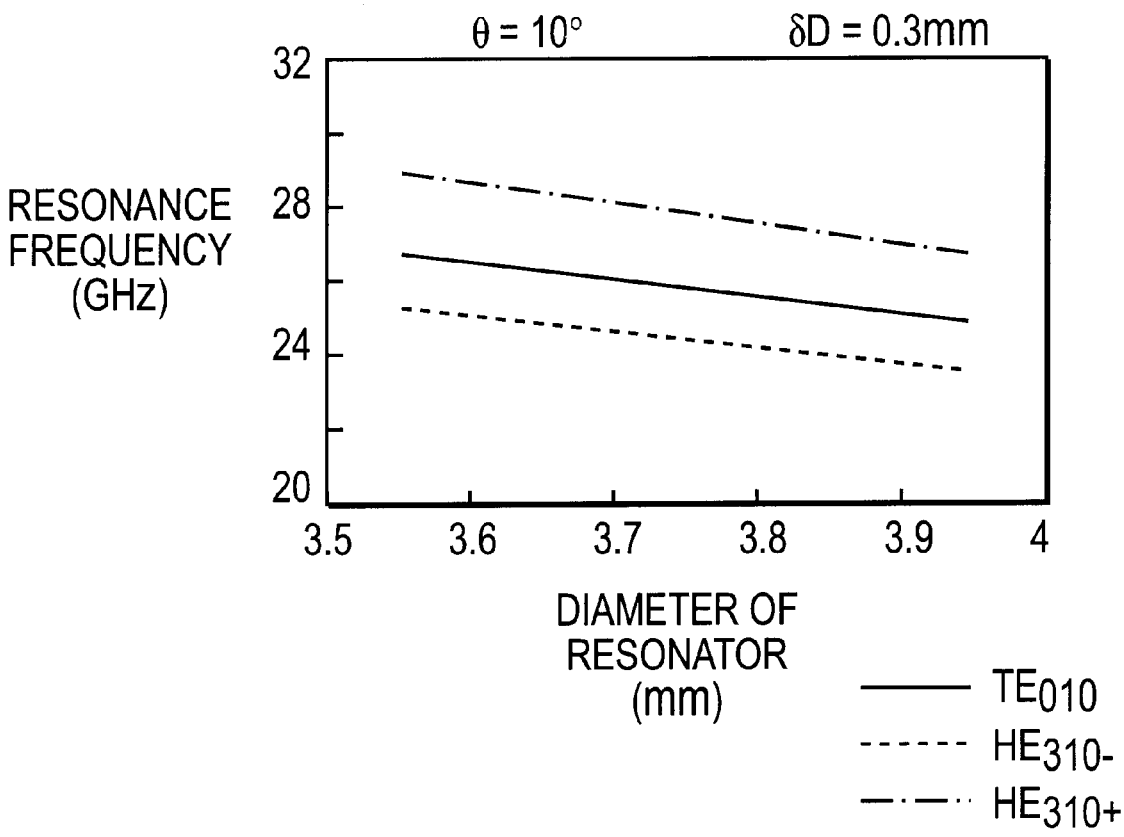
FIG. 4 shows the relationship of the resonance frequency to the diameter of resonator.
Figure 5:
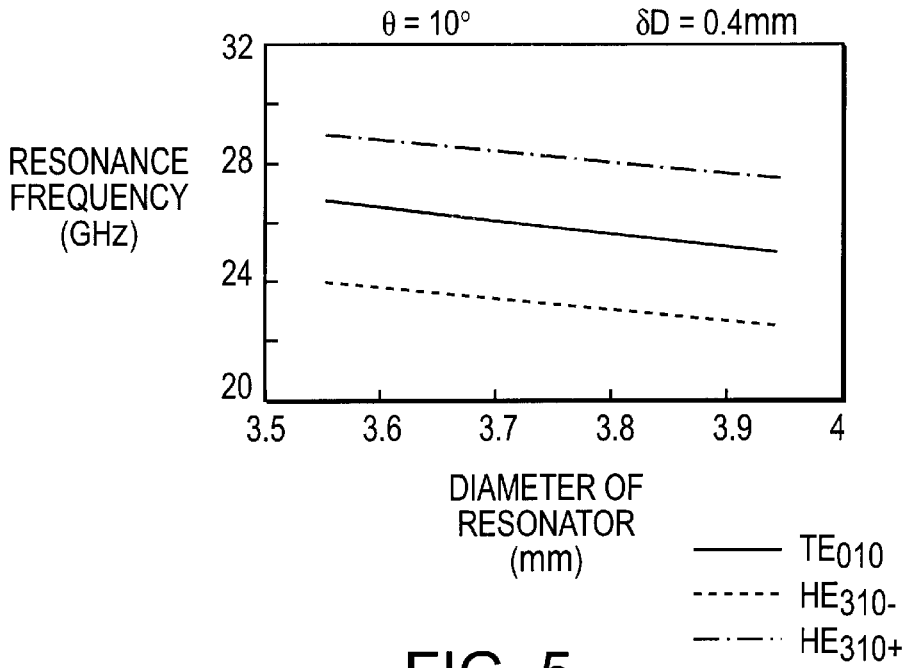
FIG. 5 shows the relationship of the resonance frequency to the diameter of resonator.
Figure 6:
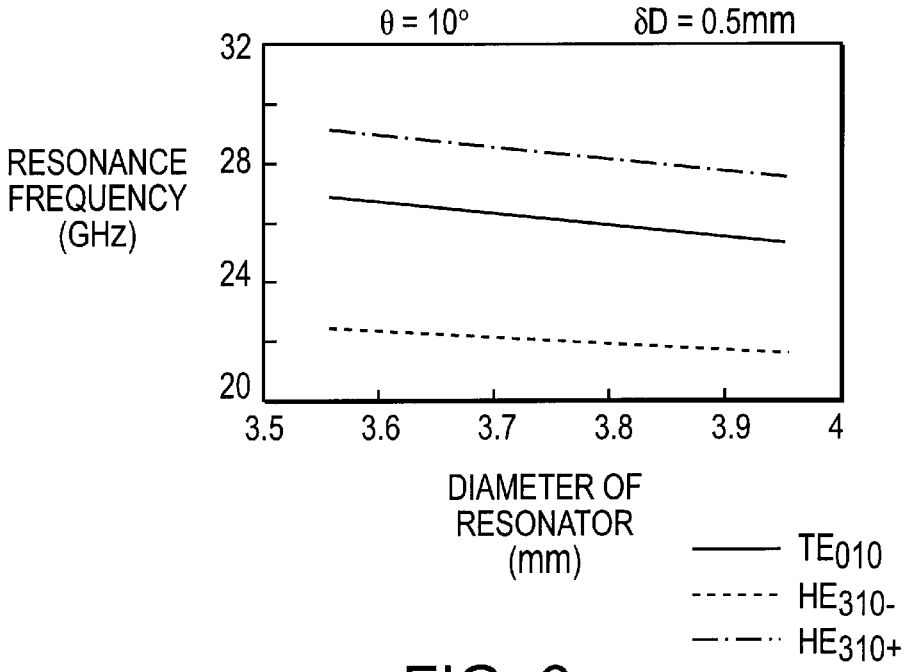
FIG. 6 shows the relationship of the resonance frequency to the diameter of resonator.
Figure 7:
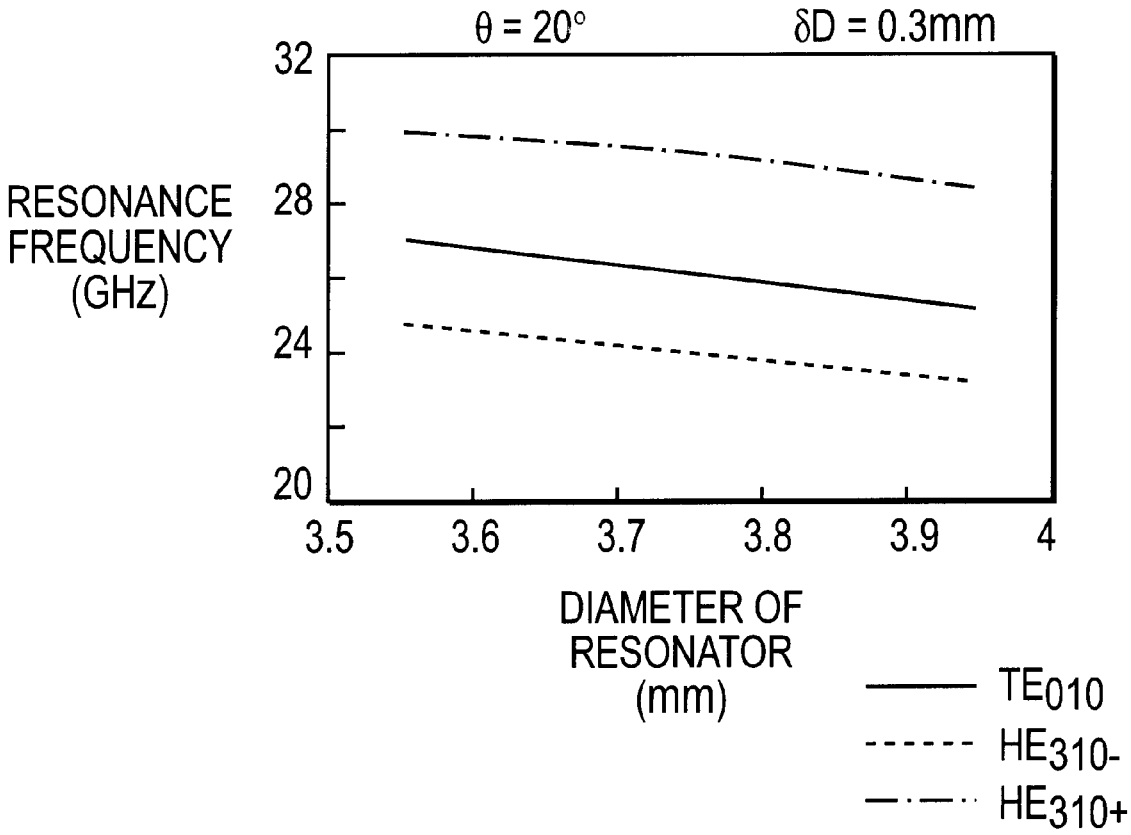
FIG. 7 shows the relationship of the resonance frequency to the diameter of resonator.
Figure 8:
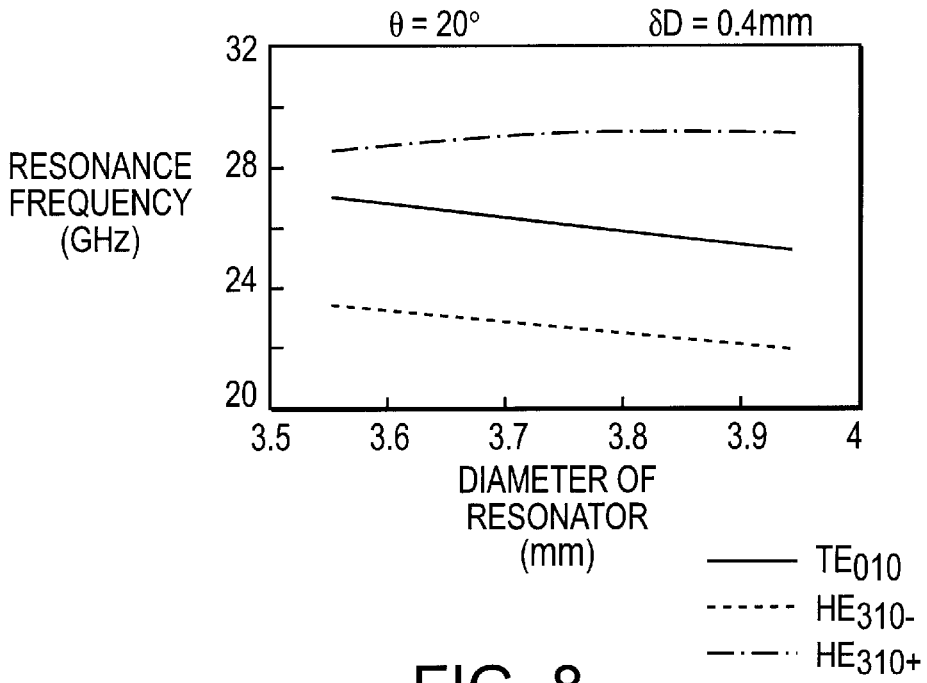
FIG. 8 shows the relationship of the resonance frequency to the diameter of resonator.
Figure 9:
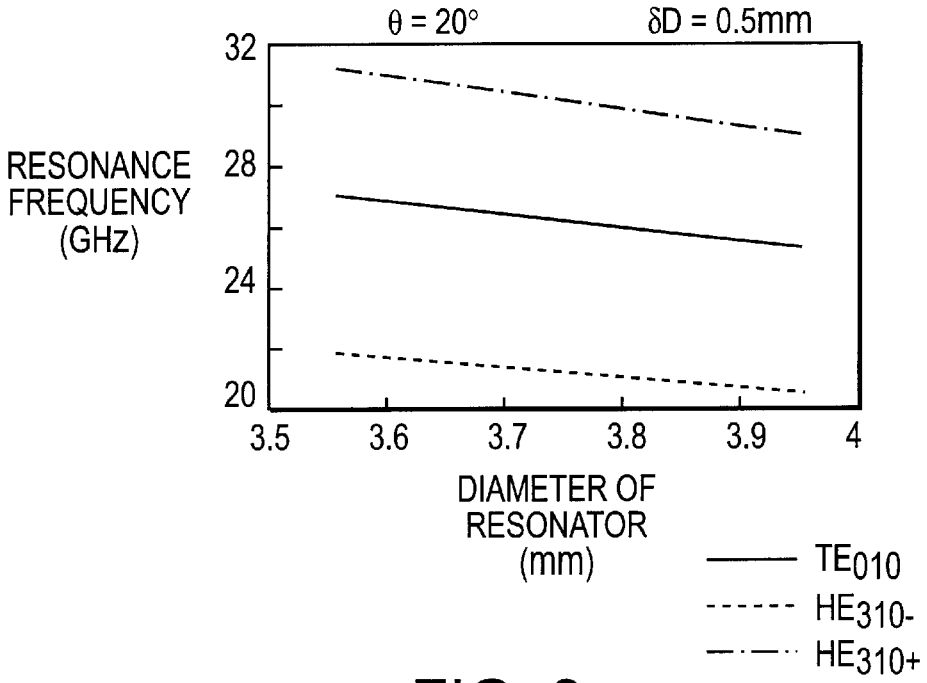
FIG. 9 shows the relationship of the resonance frequency to the diameter of resonator.
Figure 10:
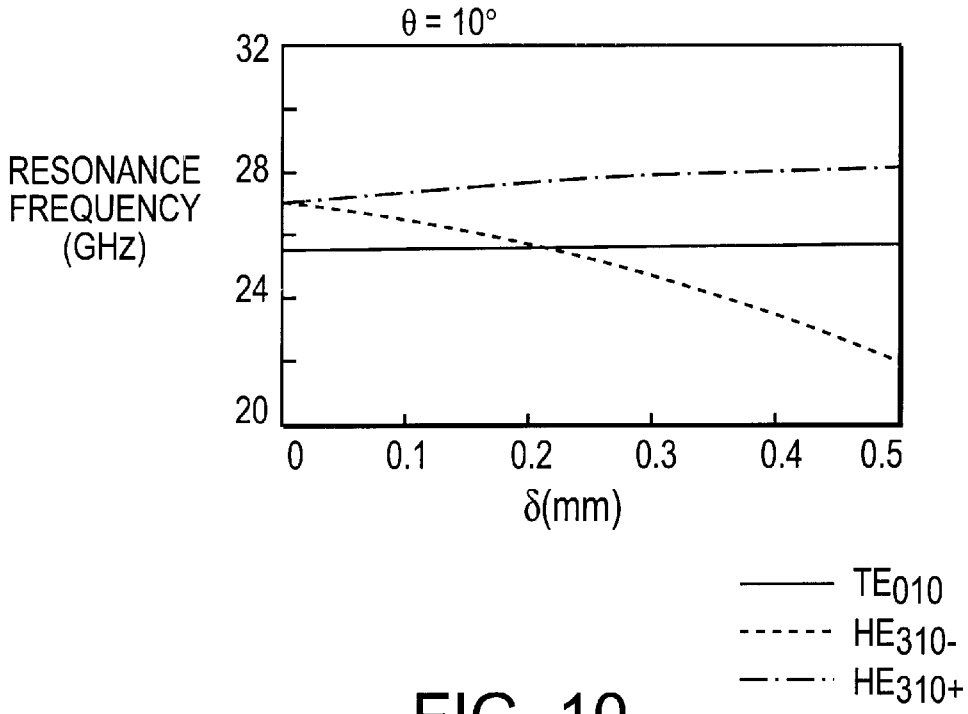
FIG. 10 shows the relationship of the resonance frequency to $\delta D$.
Figure 11:
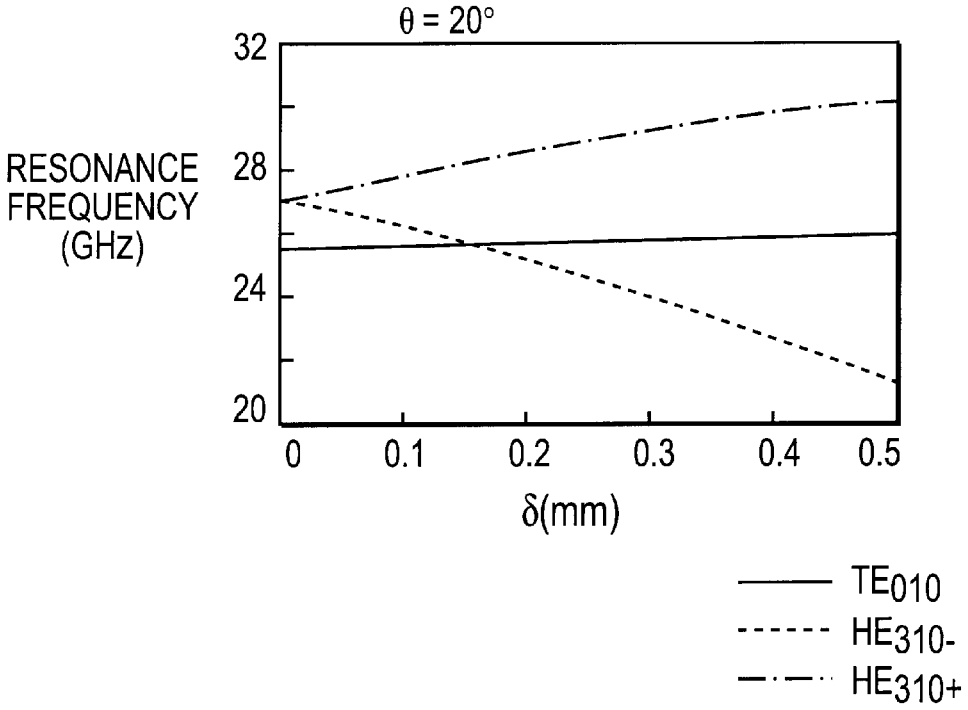
FIG. 11 shows the relationship of the resonance frequency to $\delta D$.

This is shown in FIGS. 4 through 11. The shape of the opening is as shown in FIG. 2. In the present embodiment, the respective measurements from the base to the end of all of the projections are considered to be nearly the same, and various evaluations take place on this basis, but are not limited thereto. The diameter of the electrodeless portion is represented by D, the distance between the two opposing electrode projection portions is d, and D−d, that is, twice the length of projection of the electrode projection portion 25, is δD. The angle between a line connecting one side R1 of a projection on the periphery and the center of the circle and a line connecting the opposing side R2 and the center of the circle is θ. As described above, as the width of the projection is nearly constant, θ is in proportion to the width of the projection. In FIGS. 4 through 6, the relationship of the resonance frequency to the diameter of resonator at θ=10° is shown. The condition is δD=0.3 mm in FIG. 4, δD=0.4 mm in FIG. 5, and δD=0.5 mm in FIG. 5. In FIGS. 7 through 9, the relationship of the resonance frequency to the diameter of resonator at θ=20° is shown. δD=0.3 mm in FIG. 7, δD=0.4 mm in FIG. 8, and δD=0.5 mm in FIG. 9. Further, FIG. 10 shows the relationship of the resonance frequency to δD when the diameter of the electrodeless portion is fixed at D=3.75 mm at θ=10°. FIG. 11 shows the relationship of the resonance frequency to δD at the time when the diameter of the electrodeless portion is fixed at D=3.75 mm at θ=20°. In these figures, the solid line represents the resonance frequency of the $TE_{010}$ mode, the broken line the $HE_{310}$ mode, and the one-dot chain line the $HE_{310}$ plus mode.

By comparing each of FIGS. 4 through 6 and each of FIGS. 7 through 9, it is understood that the longer the length (δD) of the electrode projection portion 25, the further the resonance frequency of an undesired resonance mode is separated from the resonance frequency of the $TE_{010}$ mode. Further, by comparing FIGS. 4 through 6 and FIGS. 7 through 9, it is understood that the larger the width (θ) of the electrode projection portion 25, the further the resonance frequency of an undesired resonance mode is separated.

Furthermore, as understood from FIGS. 10 and 11, the length (δD) of the electrode projection portion 25 is preferably 0.3 mm or more, and most preferably 0.5 mm or more. This is because the resonance frequency of an undesired resonance mode is separated far enough from the resonance mode to be used.

Figure 12:
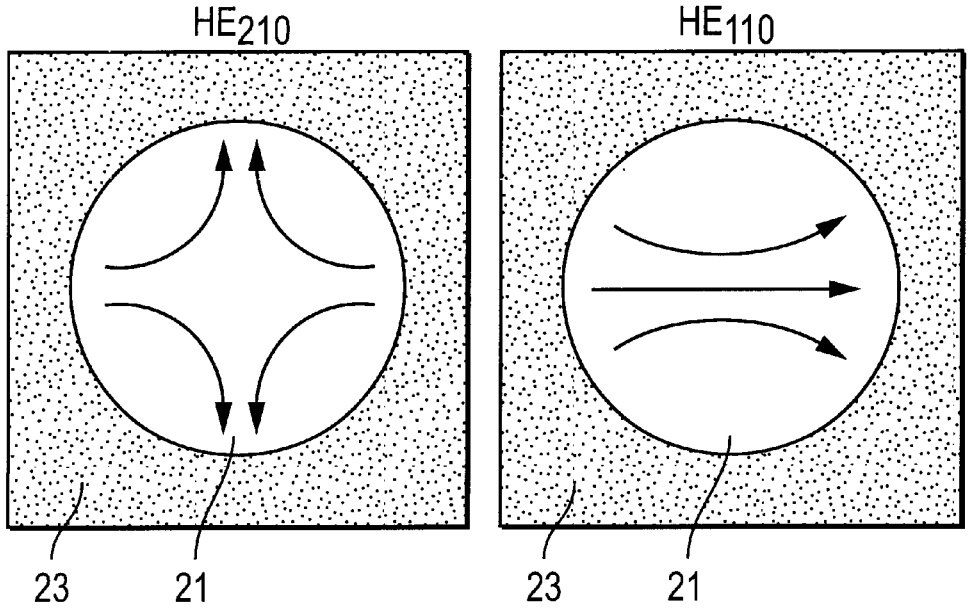
FIG. 12 shows the distribution of electric field concerning the $HE_{210}$ mode and $HE_{110}$ mode.
Figure 13:
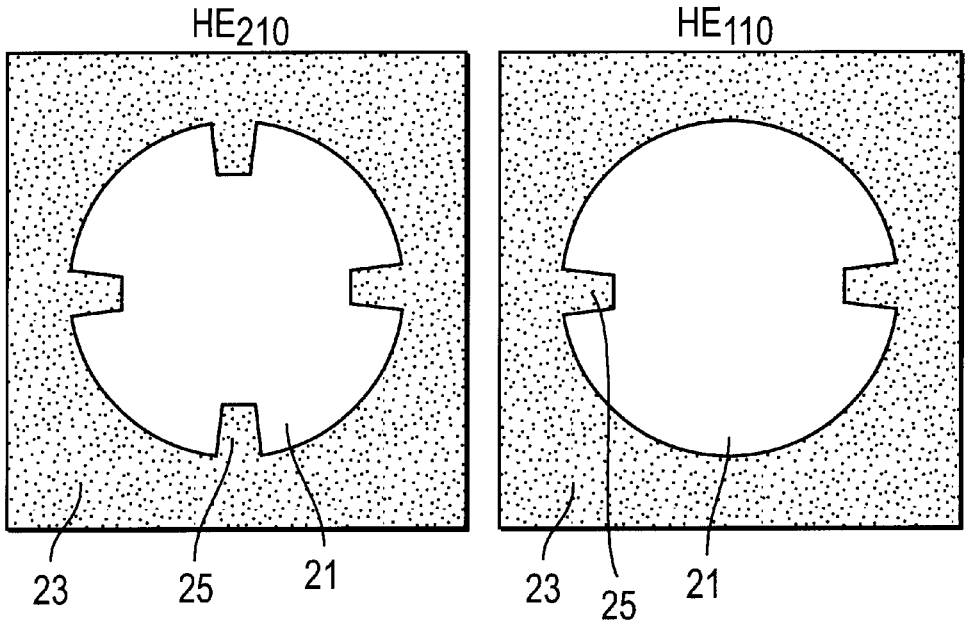
FIG. 13 is a top view showing the location of electrode projection portions corresponding to the $HE_{210}$ mode and $HE_{110}$ mode

In the above embodiment, because the undesired resonance mode is the $HE_{310}$ mode, it is desirable to provide six electrode projection portions 25 corresponding to the locations of strong electric fields. In order to separate the resonance frequencies of other undesired resonance modes, for example, the $HE_{210}$ mode and the $HE_{110}$ mode, from the resonance frequency of a mode to be used, it is enough to appropriately change the location of the electrode projection portions in accordance with the distribution of electric field. In FIG. 12, the distribution of electric field of the $HE_{210}$ mode and $HE_{110}$ mode is shown. In order to change the resonance frequency of these undesired resonance modes, it is most preferable to provide four ($HE_{210}$) and two ($HE_{110}$) electrode projection portions 25 respectively as shown in FIG. 13. In short, the projections are placed at the location where perturbation is caused so that the resonance frequency of the resonance mode to be used is little affected by the perturbation, but the resonance frequencies of undesired resonance modes are strongly influenced.

Moreover, such an object can also be attained by using striplike electrodes and island-shaped electrodes, rather than the projections illustrated above.

Figure 14:
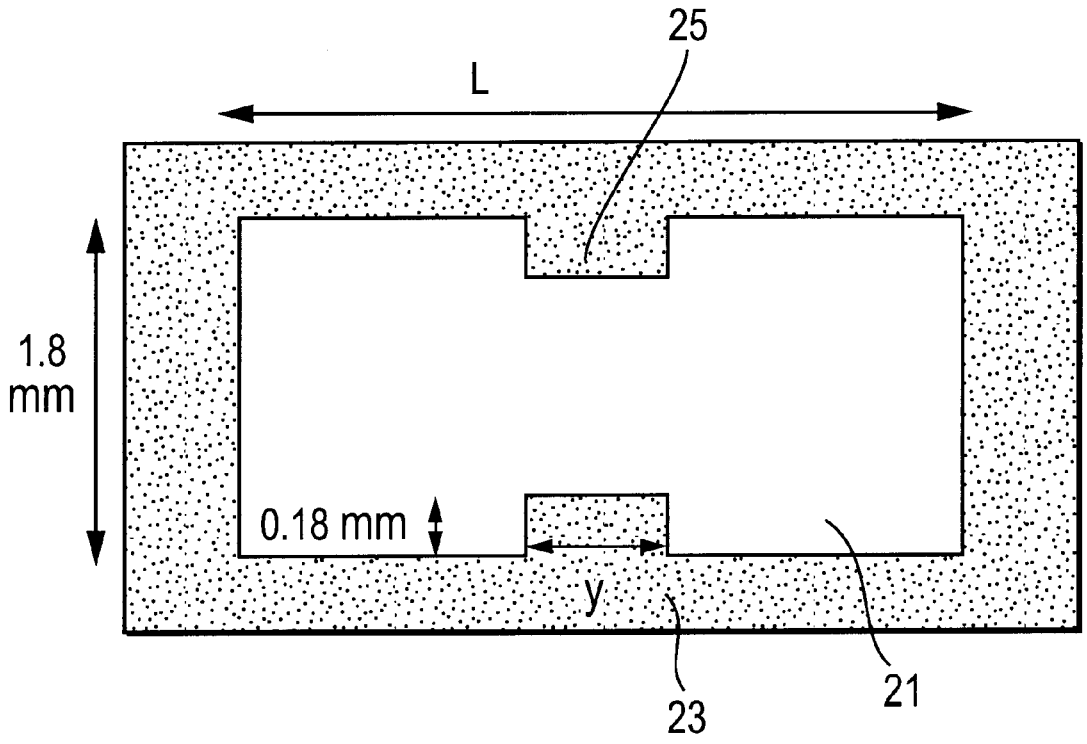
FIG. 14 is a top view showing an electrodeless portion according to another embodiment of the present invention.

Next, a second embodiment of a dielectric filter of the present invention is explained with reference to FIG. 14. The construction of the dielectric filter is nearly the same as the preceding embodiment, but in this embodiment only the shape of the electrodeless portion of the electrode on the dielectric substrate is different. That is, the electrodeless portion 21 is of a rectangular shape. When a dielectric resonator having such an electrodeless portion is constructed, it becomes possible to use the $TE_{102}$ mode.

Figure 15:
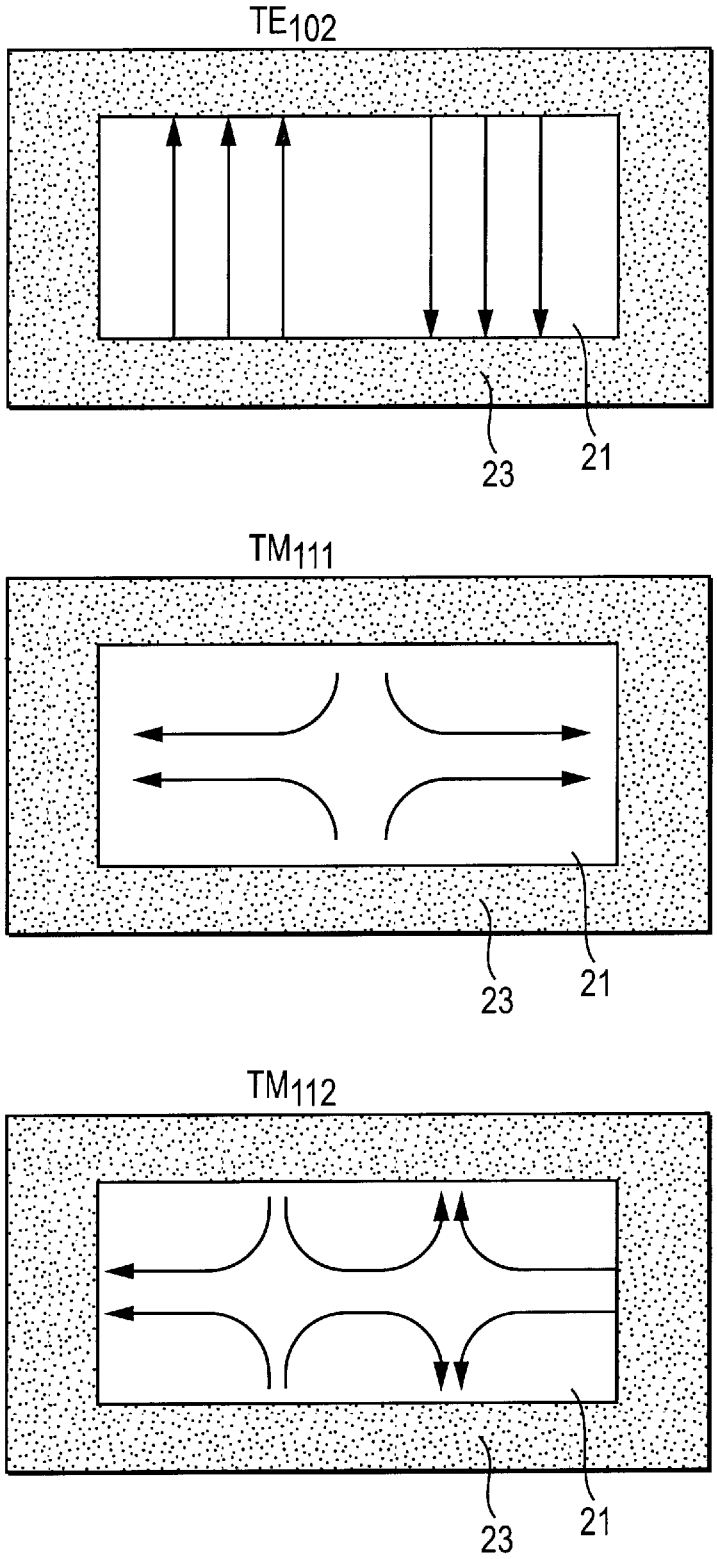
FIG. 15 shows the distribution of electric field concerning the $TE_{102}$ mode, $TM_{111}$ mode, and $TM_{112}$ mode.

In the present embodiment, electrode projection portions 25 are located nearly in the middle of the long sides of a rectangular electrodeless portion 21, respectively. Because of this, the resonance frequencies of undesired resonance modes, that is, the $TM_{111}$ mode and $TM_{112}$ mode are separated from the $TE_{102}$ mode, which is the resonance mode to be used. That is, considering the $TE_{102}$ mode, $TM_{111}$ mode, and $TM_{112}$ mode having the distribution of electric field as shown in FIG. 15, an electrode projection portion 25 nearly in the middle of a long side of the electrodeless portion 21, lowers the resonance frequency of the $TM_{111}$ mode and raises the resonance frequency of the $TM_{112}$ mode. And the resonance frequency of the $TE_{102}$ mode is little changed.

Figure 16:
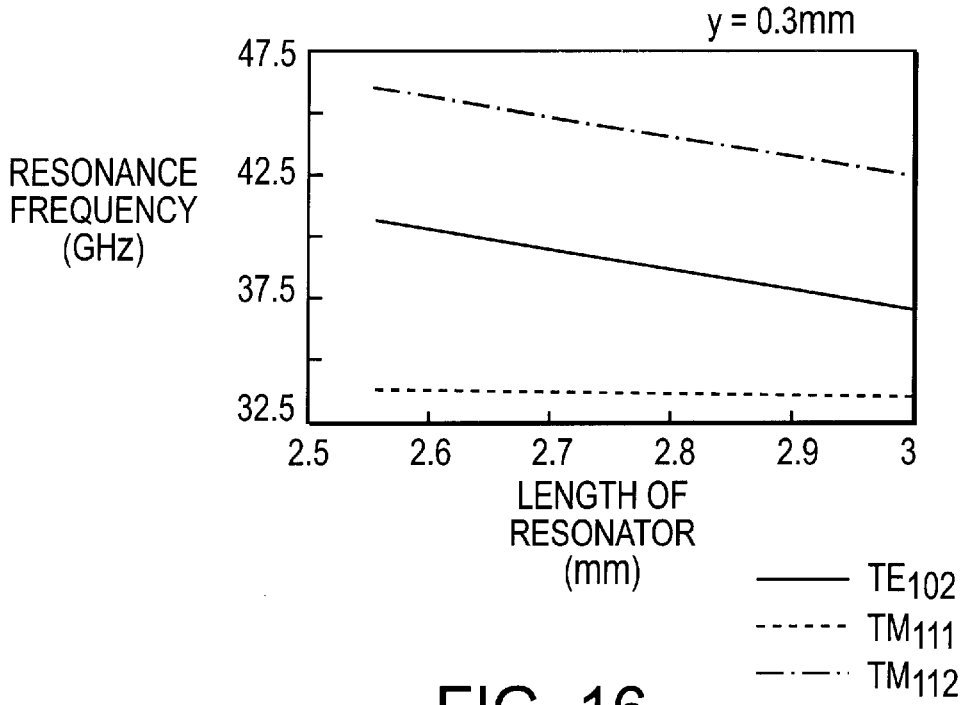
FIG. 16 shows the relationship of the resonance frequency to the length of the resonator.
Figure 17:
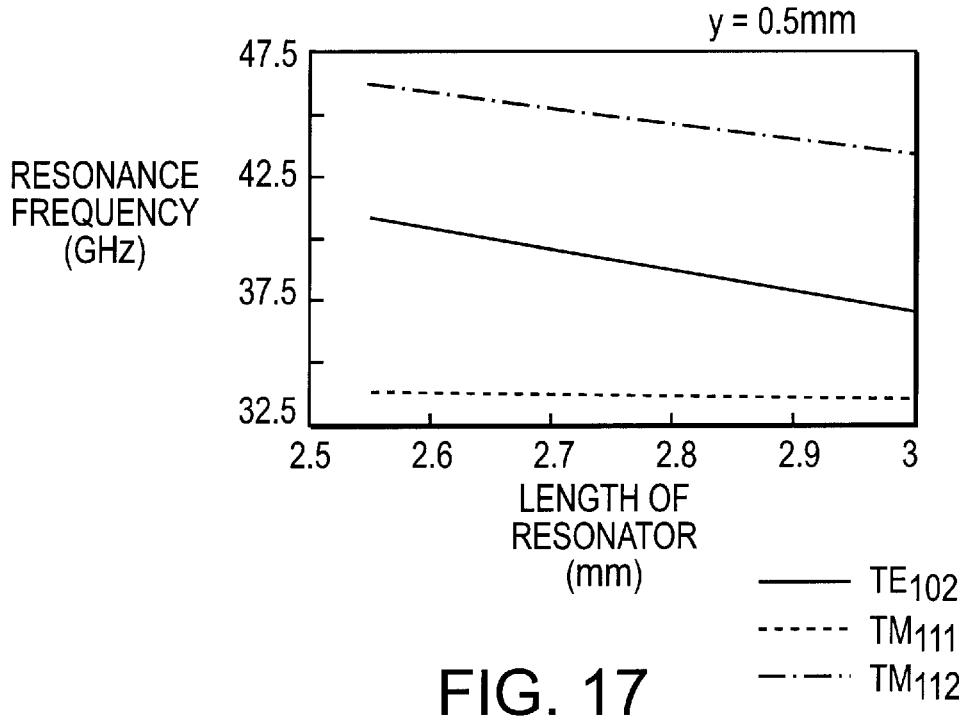
FIG. 17 shows the relationship of the resonance frequency to the length of the resonator.
Figure 18:
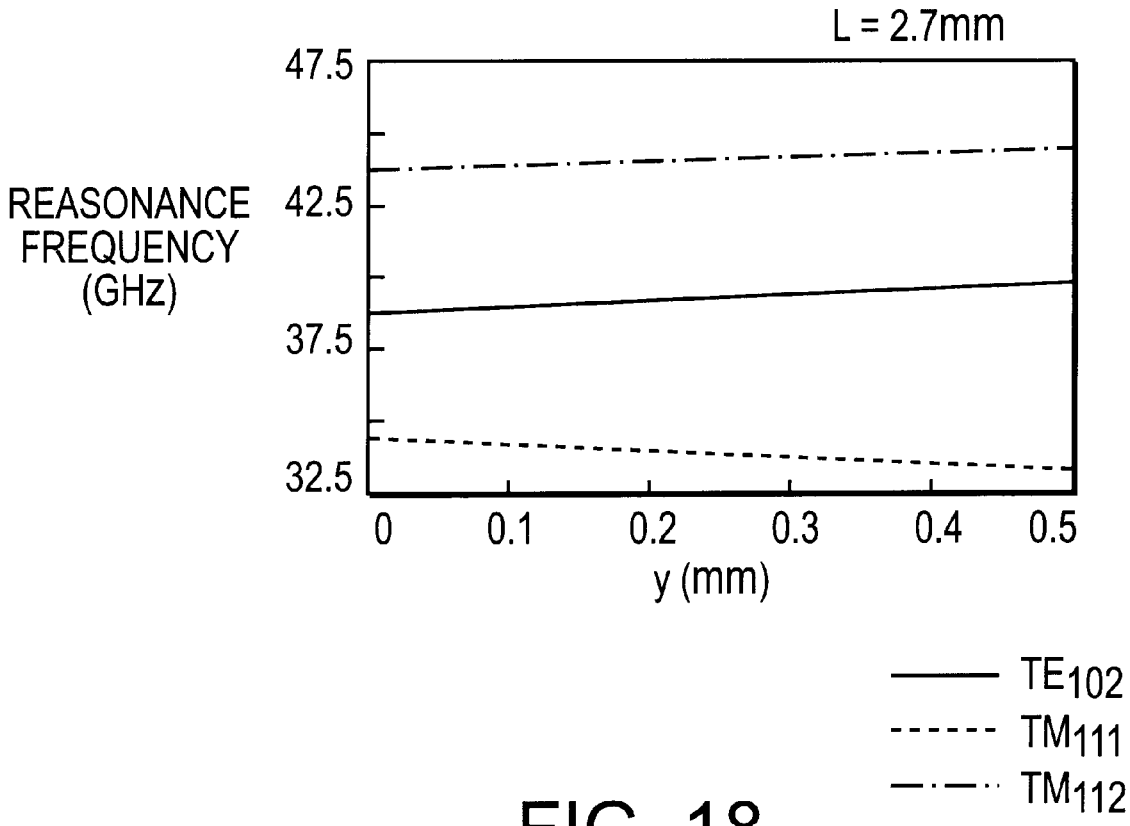
FIG. 18 shows the relationship of the resonance frequency to the width of the electrode projection portions.

These facts are shown in FIGS. 16 through 18. Here, the length of the long side of the electrodeless portion 21 (resonator length) is represented by L, and the length of the short side of the electrodeless portion 21 (resonator width) is fixed at 1.8 mm. Further, the length of the electrode projection portion 25 is fixed at 0.18 mm, and the width of the electrode projection portion 25 is represented by y. FIG. 16 shows the relationship of the resonance frequency to the resonator length at y=0.3 mm. FIG. 17 shows the relationship of the resonance frequency to the resonator length at y=0.5 mm. And FIG. 18 shows the relationship of the resonance frequency to the width (y) of the electrode projection portion 25 when the resonator length (L) is fixed at 2.77 mm. Moreover, in FIGS. 16 through 18 the solid line represents the resonance frequency of the $TE_{102}$ mode, the broken line the $TM_{111}$ mode, and the one-dot chain line the $TM_{112}$ mode.

Figure 19:
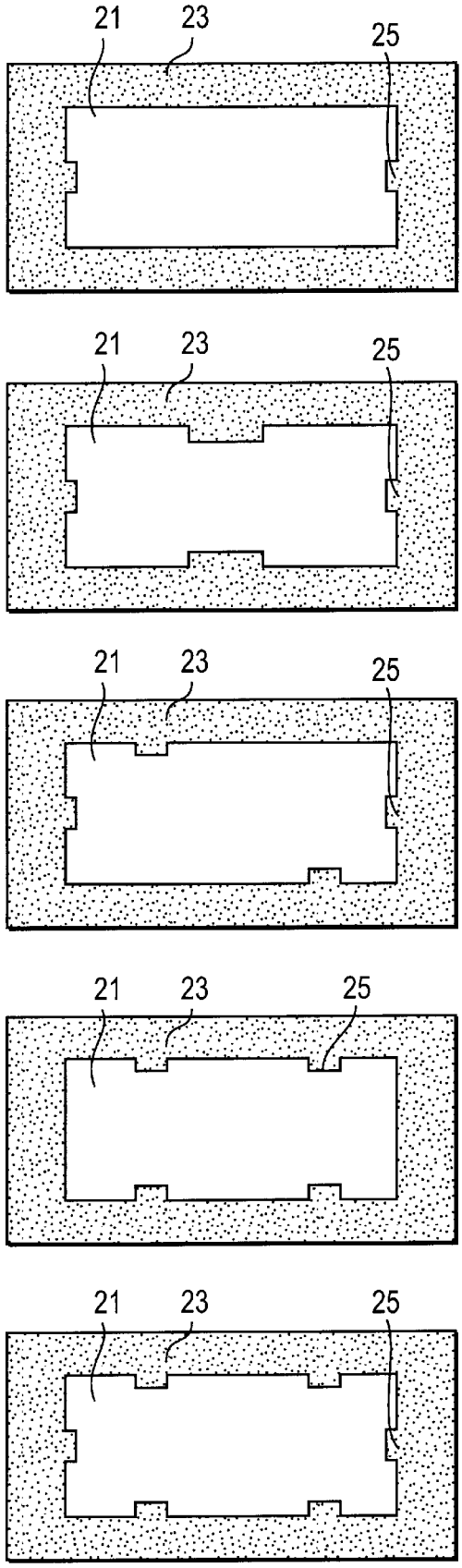
FIG. 19 shows alternative locations of various electrode projection portions.

As understood seeing these graphs, when the electrode projection portions are formed, the resonance frequencies of the undesired $TM_{111}$ mode and $TM_{112}$ mode are separated from the $TE_{102}$ mode, the resonance mode to be used. In particular, by comparison between FIG. 16 and FIG. 17 and by FIG. 18 it is understood that the larger the width of the electrode projection portion 25, the further the resonance frequency of an undesired resonance mode is separated. More, although in the present embodiment, the electrode projection portion 25 is nearly in the middle of the long side of the electrodeless portion 21, the electrode projection portion 25 may be appropriately located in accordance with the resonance mode to be used and undesired resonance modes accompanying the desired mode. That is, the electrode projection portions can be located at various locations as shown in FIG. 19.

Figure 20:
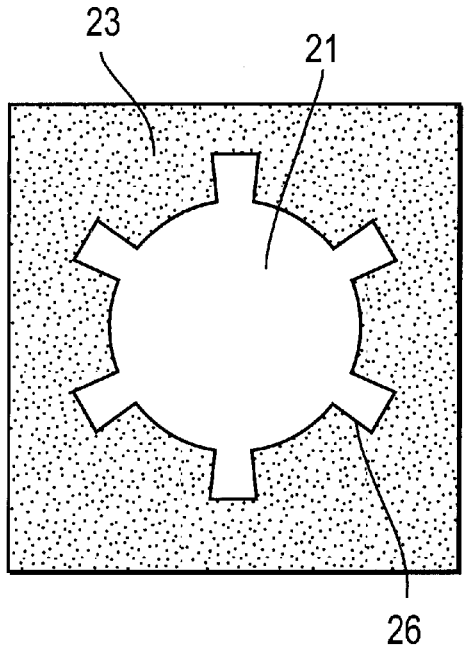
FIG. 20 is a top view showing recessed electrode portions located in the boundary region.

An embodiment of another dielectric filter according to the present invention is explained on the basis of FIG. 20. The construction of the dielectric filter is nearly the same as the first embodiment, but only the shape of the electrodeless portion of the electrode formed on the dielectric substrate is different.

Six recessed portions 26 face outward from the electrodeless portion at the boundary portion between the electrode 23 and the electrodeless portion 21 formed on the dielectric substrate. Because of this, the resonance frequency of the $HE_{310}$ mode (an undesired resonance mode) is separated from the resonance frequency of the $TE_{010}$ mode of a resonance mode to be used and a dielectric filter where sufficient damping is available in the vicinity of the bandwidth can be obtained. When the $HE_{210}$ mode and $HE_{110}$ mode constitute the undesired modes, it is enough to appropriately change the locations of the recessed portions based on the distribution of the electric field of these modes. Then, the guiding principle is as in the explanation of the first embodiment.

The above is also applicable to a dielectric filter having a rectangular electrodeless portion.

Figure 21:
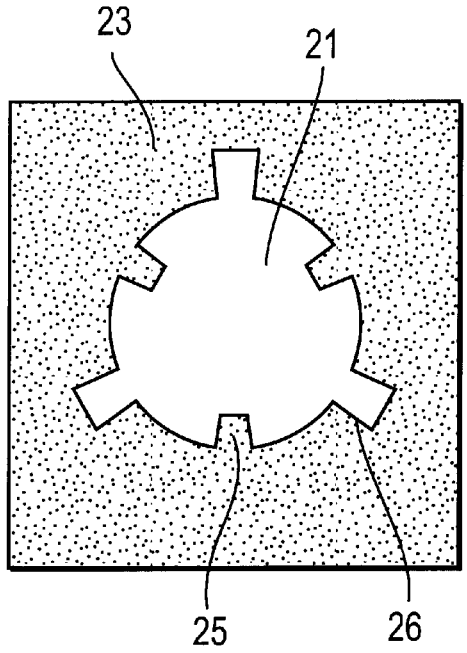
FIG. 21 is a top view showing a combination of electrode projection portions and recessed electrode portions.

Further, a combination of electrode projection portions 25 and recessed portions 26 as shown in FIG. 21 is also applicable and by changing the locations of the electrode projection portions 25 and recessed portions 26 and their sizes, various designs become possible.

Figure 22:
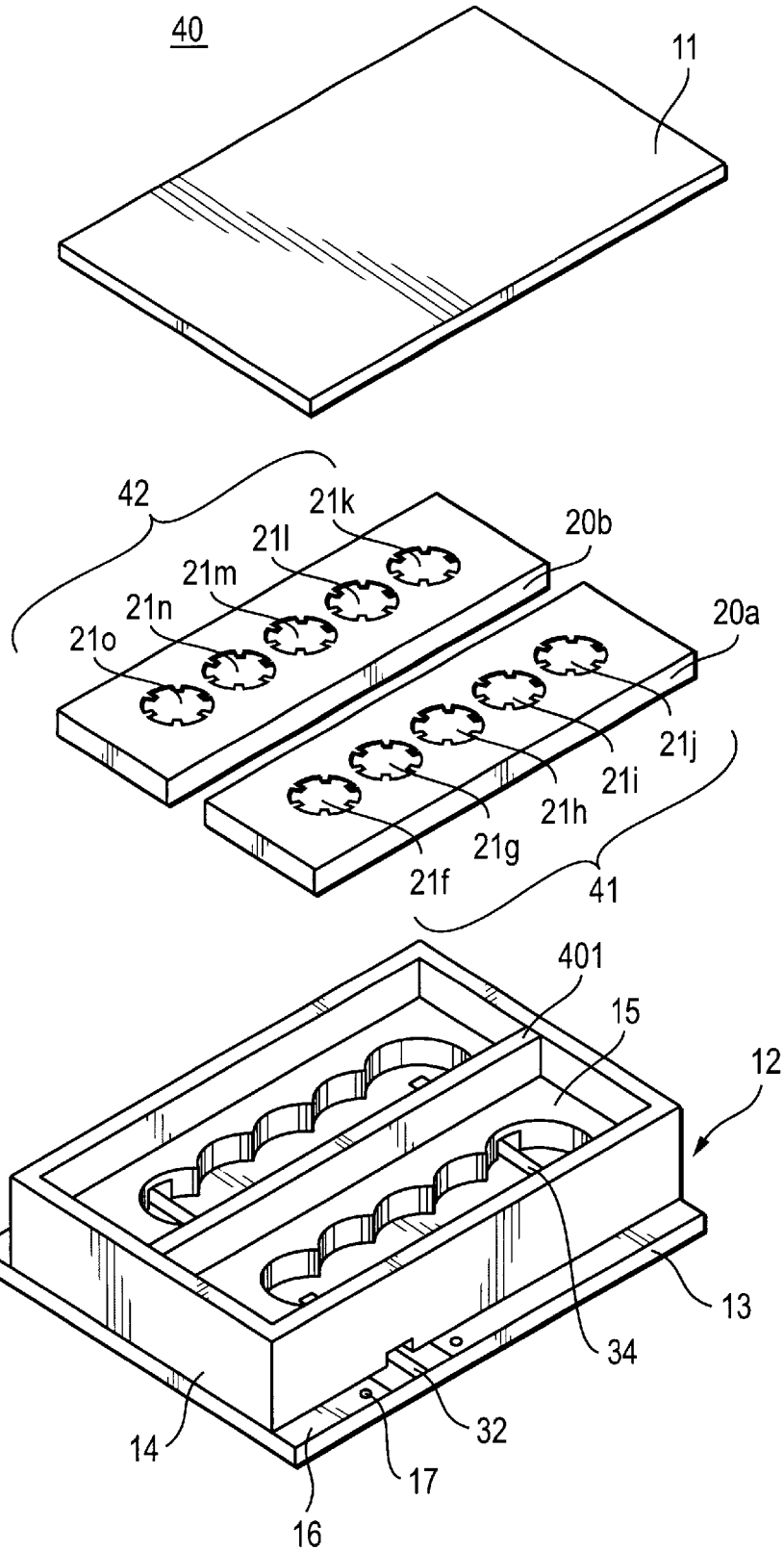
FIG. 22 is an exploded perspective view of a dielectric duplexer according to an embodiment of the present invention.

A dielectric duplexer as an embodiment of the present invention is explained on the basis of FIG. 22.

The dielectric duplexer 40 is composed of a first dielectric filter portion 41 of five dielectric resonators made up of five electrodeless portions 21*f* through 21*j* on a dielectric substrate 20*a* on the two main surfaces of which electrodes are formed, and a second dielectric filter portion 42 of five dielectric resonators made up of another five electrodeless portions 21*k* through 21*o* on a dielectric substrate 20*b*. The five dielectric resonators constituting the first dielectric filter portion 41 are magnetically coupled respectively and constitute a transmission bandpass filter. The five dielectric resonators constituting the second dielectric filter portion 42 have resonance frequencies different from those of the dielectric resonators of the first dielectric filter portion 41, are also magnetically coupled and constitute a reception bandpass filter.

A microstrip line 32 to be coupled to the dielectric resonator 21*f* as an input stage of the dielectric filter portion 41 is connected to an outside transmission circuit. And a microstrip line 33 to be coupled to the dielectric resonator 21*o* as an output stage of the dielectric filter portion 42 is connected to an outside reception circuit. Further, a microstrip line 34 to be connected to the dielectric resonator 21*j* as an output stage of the first dielectric filter and a microstrip line 35 to be coupled to the dielectric resonator 21*k* as an input stage of the second dielectric filter 42 are commonly connected to a microstrip line (not shown) serving as an antenna connector for being connected to an outside antenna.

The dielectric duplexer 40 functions as a bandpass dielectric duplexer wherein a first fixed frequency passes through the first dielectric filter and a second fixed frequency different from the preceding frequency passes through the second dielectric filter.

Moreover, in order to isolate the first dielectric filter portion 41 and the second dielectric filter portion 42, a metal or metal-coated separator (401) is put in between the first dielectric filter portion 41 and the second dielectric filter portion 42.

Figure 23:
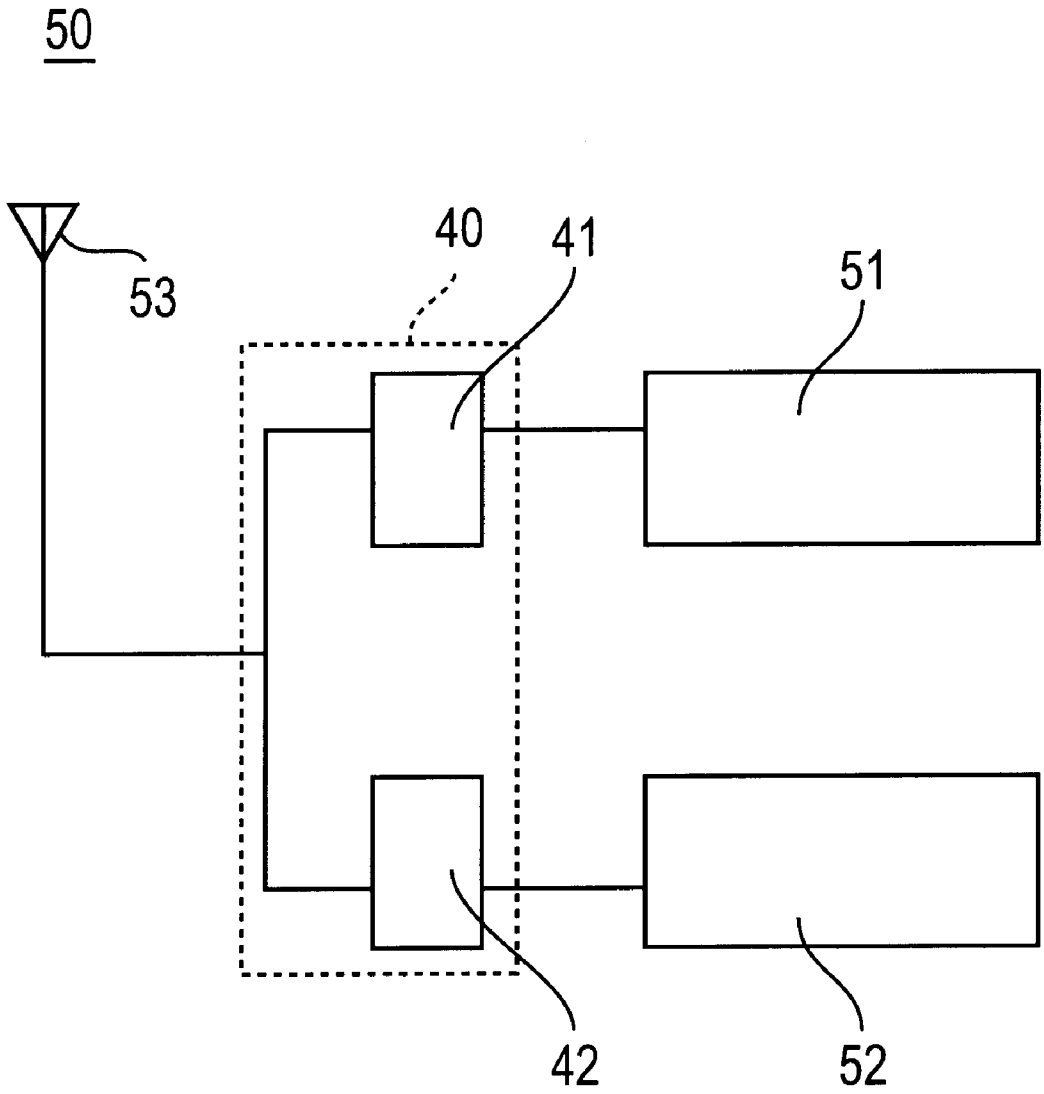
FIG. 23 is a schematic illustration of a communication device according to an embodiment of the present invention.

Further, a communication device as an embodiment of the present invention is explained on the basis of FIG. 23.

The communication device 50 is composed of a dielectric duplexer 40, a transmission circuit 51, a reception circuit 52, and an antenna 53. Here, the dielectric duplexer is what was shown in the above embodiment, an input-output connector is connected between the first dielectric filter portion 41 in FIG. 22 and the transmission circuit 51, and another input-output connector is connected between the second dielectric filter portion 42 and the reception circuit 52. Further, an antenna connector is connected to both filter portions for being connected to the antenna 53.

Figure 24:
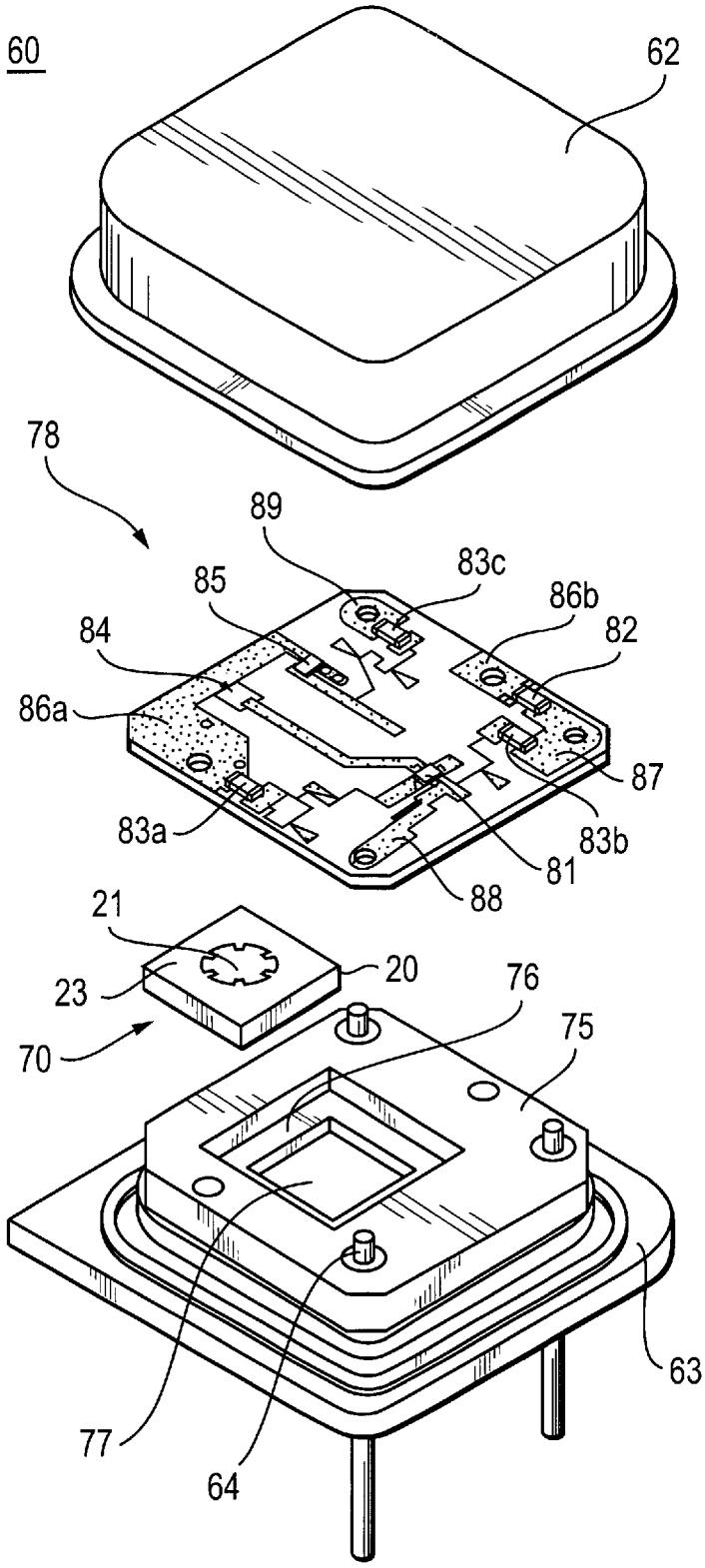
FIG. 24 is an exploded perspective view of an oscillator according to an embodiment of the present invention.

Further, an oscillator as an embodiment of the present invention is explained on the basis of FIG. 24. This oscillator is related to that shown in U.S. Ser. No. 09/315,737 filed May 20, 1999, the disclosures of which are incorporated by reference herein. See particularly FIG. 5 in the '737 application, which shows an oscillator substantially the same as that in FIG. 24, only the resonator being different from that disclosed herein. See also the circuit boards shown in FIGS. 1 and 3 of the '737 application for relevant background information.

The oscillator 60 is composed of a cap 62 and stem 63, a frame 75, a resonator 70, and a circuit board 78. The cap 62, frame 75, and stem 63 are made up of, for example, iron so that they have nearly the same linear expansion coefficient as that of the resonator 70, and the cap 62 and stem 63 are bonded by a hermetic seal. More, at the three corner portions of the stem 63 terminal pins 64 are set.

In the resonator 70, electrodes 23 are formed on the opposing two surfaces of a rectangular dielectric substrate 20 and nearly circular electrodeless portions 21 are formed at nearly central portions of the electrodes 23 which are opposed to each other. The resonator 70, cap 62, and stem 63 which have such a construction constitute a resonator where an electromagnetic field is concentrated around the nearly circular electrodeless portion 21.

In the nearly central portion of the frame 75, a first recessed portion 76 which is larger than the resonator 70 is provided. In order to leave a space around the electrodeless portion 21 on the lower surface of the resonator 70, a second recessed portion 77 is provided. And in this first recessed portion 76 the resonator 70 is arranged.

The circuit board 78 is constructed by forming a pattern of microstrip lines having a main conductor on the top surface of a substrate made up of a well known resin (for example, Mitsubishi Chemical BT® resin) and an earth conductor on the bottom and by arranging an FET 81 and chip capacitor 82, chip resistors 83*a,* 83*b,* and 83*c,* a film terminating resistor 84 and a varactor diode 85. One end of a main line of a microstrip line is connected to the gate of the FET 81 by wire bonding and the other end is connected to the film terminating resistor 84. A microstrip line connected to the source of the FET 81 is connected to an earth electrode 86*a* through the chip resistor 83*a*. Further, one end of a microstrip line connected to the drain of the FET 81 is connected to an input terminal electrode 87 through the chip resistor 83*b*. The input terminal electrode 87 is connected to an earth electrode 86*b* through the chip capacitor 82. The drain of the FET 81 is also connected to an output terminal electrode 88 through a capacitance component of a gap in a microstrip line.

A fixed location of a secondary line of a microstrip line is connected to the earth electrode 86*a* through the varactor diode 85. A microstrip line led out from another location is connected to a bias terminal electrode 89 through the chip resistor 83*c*. When a voltage is applied to the varactor diode 85, the capacitance of the varactor diode 85 changes, and because of the change the oscillation frequency of the oscillator 60 can be changed.

Thus, after the frame 75 is set on the stem 63 and the resonator 70 is housed in the recessed portion 76 of the frame 75, the circuit board 78 is mounted on that. The terminal pins 64 set in the three comer portions of the stem 63 and frame 75 are inserted into the holes given in the portions of the input terminal electrode 87, output terminal electrode 88, and bias terminal electrode 89 of the circuit board 78, and connected to their terminal electrodes 87, 88, and 89, respectively. The holes given in the circuit board 78 have the same shape as the terminal pins 64 so as to be always connected to the terminal pins 64.

Figure 25:
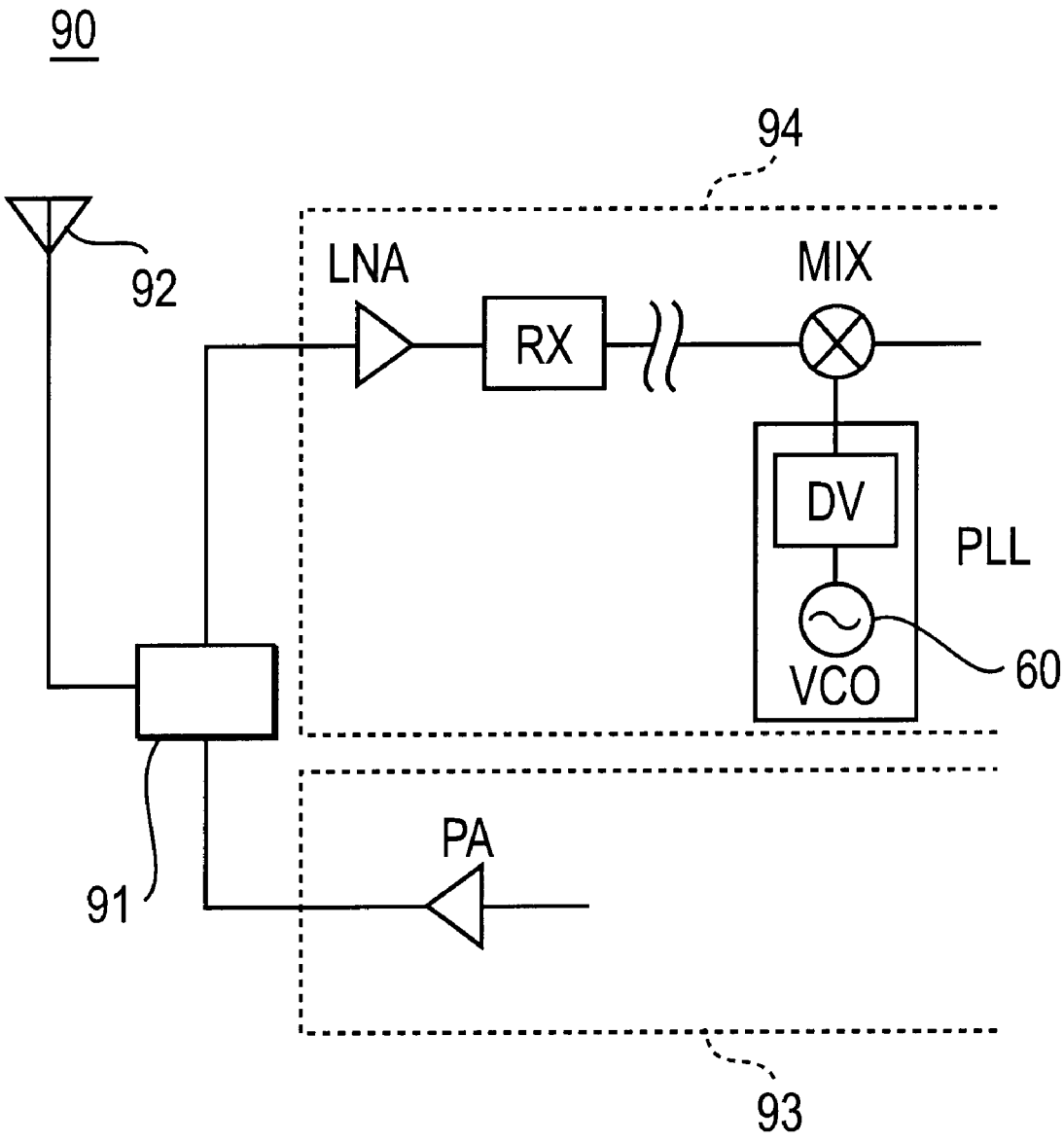
FIG. 25 is a schematic illustration of another communication device according to an embodiment of the present invention.
Figure 26:
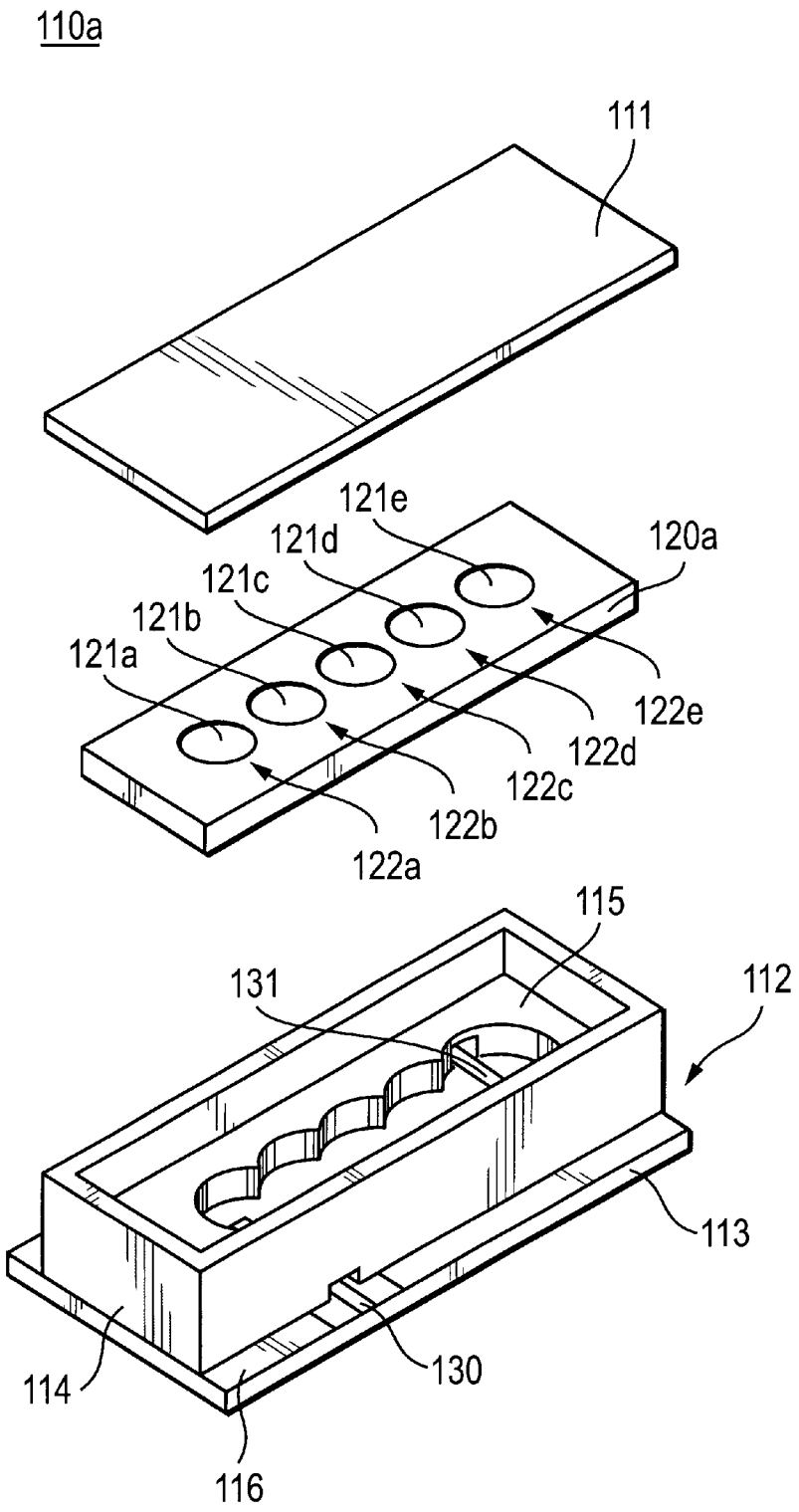
FIG. 26 PRIOR ART
FIG. 26 is an exploded perspective view of a first example of a conventional dielectric filter.
Figure 27:
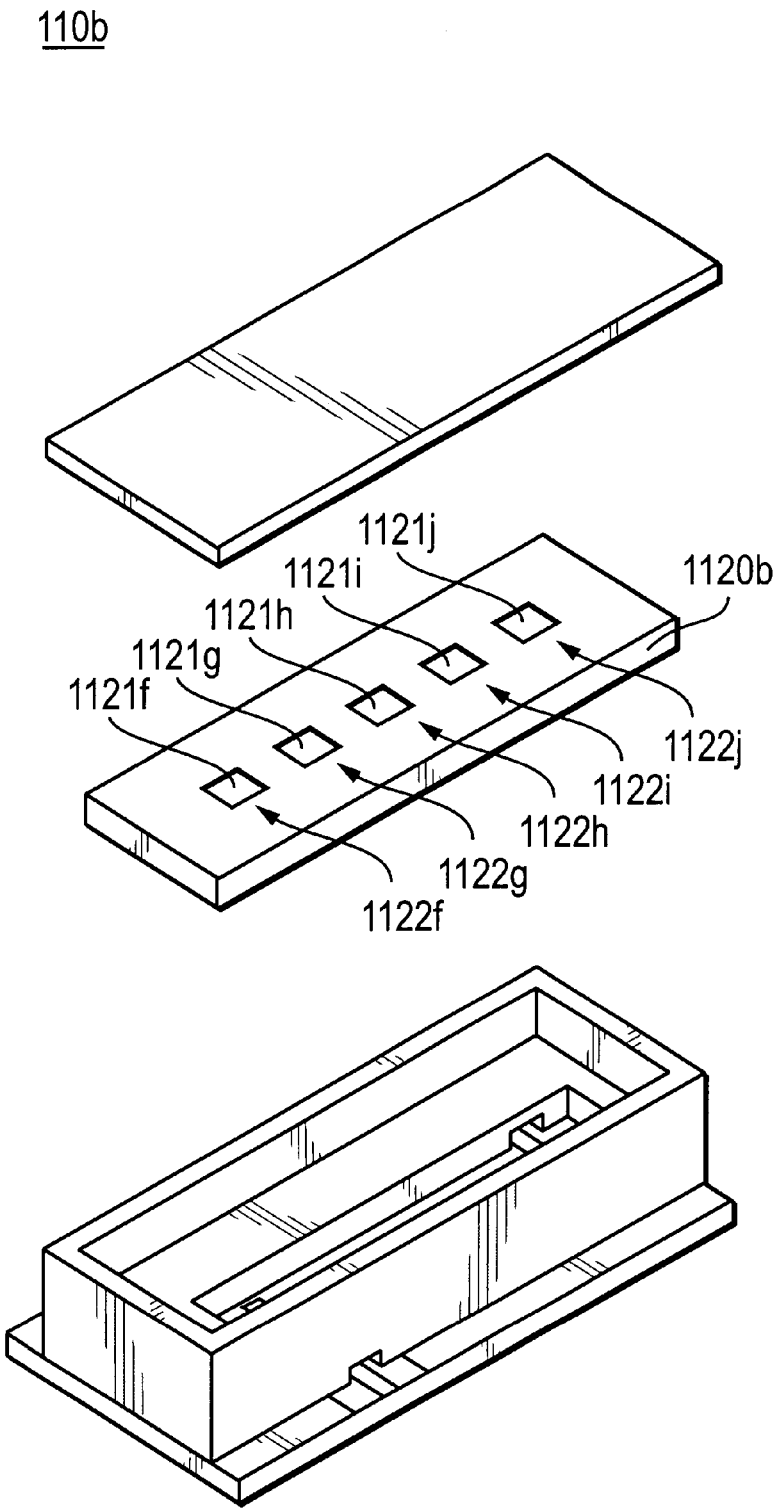
FIG. 27 PRIOR ART
FIG. 27 is an exploded perspective view of a second example of a conventional dielectric filter.
Figure 28:
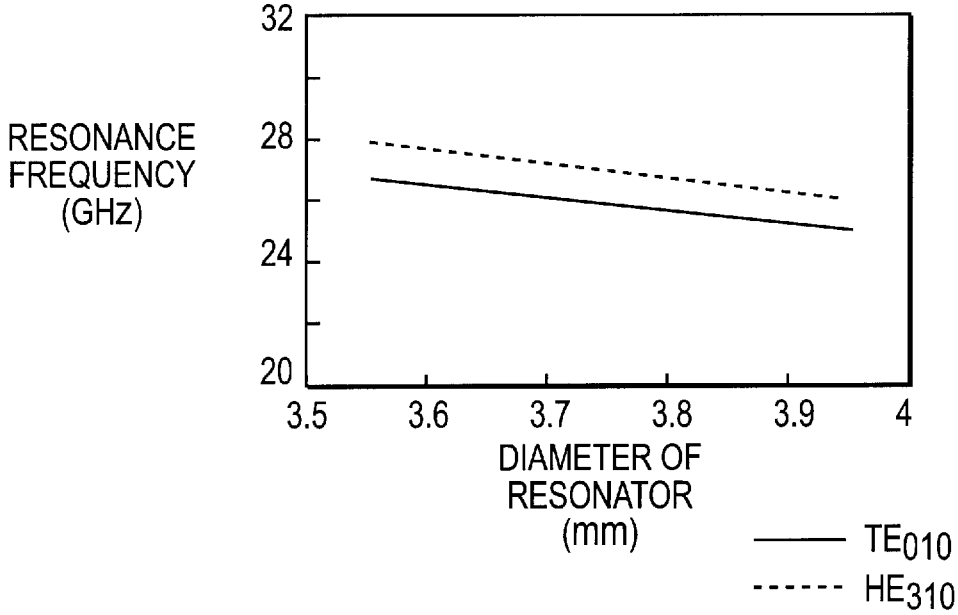
FIG. 28 PRIOR ART
FIG. 28 shows the relationship of the resonance frequency to the diameter of resonator in FIG. 26.
Figure 29:
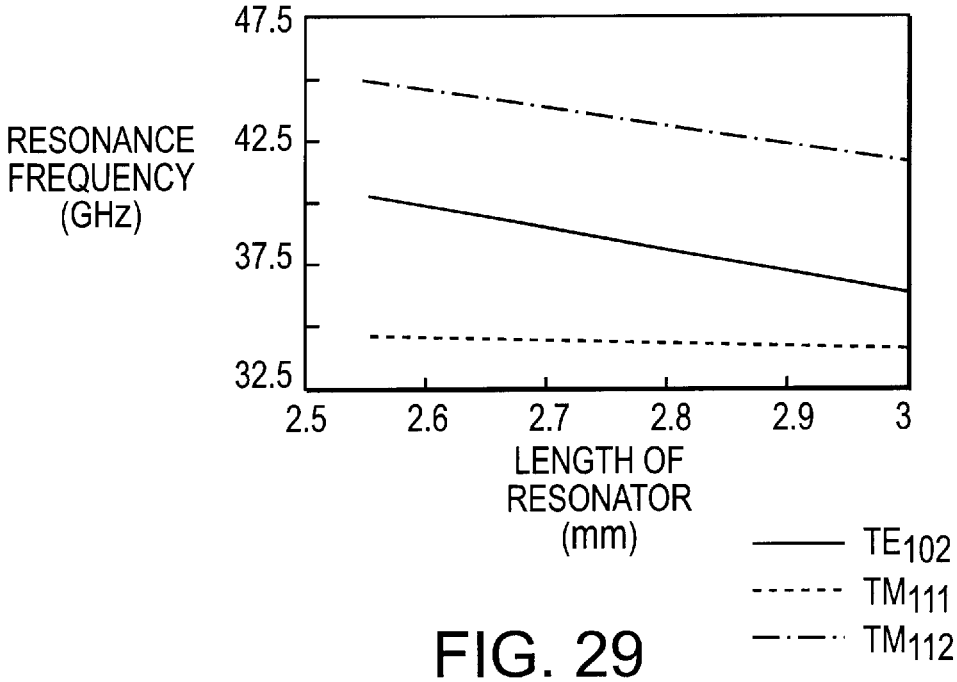
FIG. 29 PRIOR ART
FIG. 29 shows the relationship of the resonance frequency to the length of resonator in FIG. 27.

Further, a communication device as an embodiment of the present invention which is different from the above communication device is explained on the basis of FIG. 25.

The communication device 90 is composed of a duplexer 91 made up of a transmission filter and reception filter, an antenna to be connected to an antenna connection terminal of the duplexer 91, a transmission circuit 93 to be connected to an input-output terminal on the side of the transmission filter of the duplexer 91, and a reception circuit 94 to be connected to an input-output terminal on the side of the reception filter of the duplexer 91.

A power amplifier (PA) is included in the transmission circuit 93, and a transmission signal is amplified by the power amplifier and transmitted from the antenna 92 through the transmission filter. A reception signal is given to the reception circuit 94 from the antenna 92 through the reception filter. After the reception signal has passed through a low-noise amplifier (LNA), a filter (RX), etc. in the reception circuit 94 the reception signal is input into a mixer (MIX). The reception circuit 94 also comprises a local oscillator having a phase-locked loop (PLL) which is composed of an oscillator 60 (VCO) and a divider (DV) which outputs a local signal to the mixer. Then, an intermediate frequency is output.

In the above dielectric duplexer, oscillator, and communication device also, the electrode projection portions or recessed portions are formed at fixed locations in the boundary region between the electrode and the electrodeless portion formed on the dielectric substrate. Because of this, the resonance frequency of an undesired resonance mode is separated from the resonance frequency of a resonance mode to be used, and a dielectric duplexer, oscillator, and communication device which have good passing characteristics or reflection characteristics can be obtained.

As explained above, according to the present invention, in a dielectric resonator comprising an electrode and electrodeless portion formed on the two main surfaces of a dielectric substrate and a conductor arranged so as to be a fixed distance away from the dielectric substrate or a dielectric filter containing such a dielectric resonator electrode, projection portions or recessed portions of electrode are located in the boundary portion between the electrode and electrodeless portion formed on the dielectric substrate. Further, the electrode projection portions or recessed portions were formed at appropriate locations in accordance with the distribution of electric field of a resonance mode to be used and undesired resonance mode. Because of this, the resonance frequency of an undesired resonance mode is separated from the resonance frequency of a resonance mode to be used, and the resonance of the undesired resonance mode is thereby removed from the vicinity of the bandwidth, and, as a result, the passing characteristic or reflection characteristic is improved.

Regarding the material of the projection, any material giving perturbation to the distribution of electric field of a mode as a target suffices. From a view-point of manufacture and degree of perturbation, a metal electrode projection is the most realistic, but the material of the projection may be different from the material of the electrode. For example, such a combination of Fe and Cu, Fe and Al, Cu and Ag, etc. can be used.

While the invention has been particularly shown and described with reference to embodiments, it will be understood by those skilled in the art that the foregoing and other changes in form and details can be made without departing from the spirit and scope of the invention.

What is claimed is:

1. A dielectric resonator comprising a dielectric substrate having two opposing main surfaces on which electrodes are formed, electrodeless portions formed in the electrodes on the two main surfaces, and a conductor arranged a fixed distance away from the dielectric substrate, wherein at the boundary between the electrodeless portion and the electrode at least one electrode projection portion is provided so as to extend into the electrodeless portion.

2. A dielectric resonator as claimed in claim 1, wherein the dielectric resonator has an undesired resonance mode, and the at least one electrode projection portion is provided at a location corresponding to the undesired resonance mode.

3. An oscillator comprising a dielectric resonator as claimed in any one of claims 1–2, a frame containing the dielectric resonator, and a circuit board.

4. A communication device comprising a high frequency circuit comprised in at least transmission circuit and a reception circuit, and an antenna, wherein the high frequency circuit comprises the oscillator as claimed in claim 3.

5. A dielectric filter comprising a dielectric resonator as claimed in any one of claims 1–2 and further comprising input-output connectors coupled to said dielectric resonator.

6. A dielectric duplexer comprising at least two dielectric filters, an input connector connected to one of the dielectric filters, an output connector connected to the other dielectric filter, and an antenna connector commonly connected to both of the dielectric filters, wherein at least one of the dielectric filters is a dielectric filter as claimed in claim 5.

7. A communication device comprising a dielectric duplexer as claimed in claim 6, a transmission circuit connected to said input connector of the dielectric duplexer, a reception circuit connected to said output connector of said dielectric duplexer, and an antenna connected to said antenna connector of the dielectric duplexer.

8. A dielectric resonator as claimed in claim 1, wherein said at least one electrode projection is disposed on said dielectric substrate.

9. A dielectric resonator as claimed in claim 1, wherein said at least one electrode projection portion comprises a plurality of said electrode projection portions.

10. A dielectric resonator comprising:

a dielectric substrate;

a pair of electrode plates on two opposing main surfaces of the dielectric substrate;

a respective pair of electrodeless portions formed in the electrode plates so as to be opposed to each other through the dielectric substrate;

a resonance cavity made up of a metal enclosure enclosing the electrodeless portions;

an input electrode providing access to the resonance cavity from the outside; and an output electrode for taking a signal out of the resonance cavity, further comprising an element arranged in the resonance cavity for giving perturbation to an electromagnetic field, said element being a part of one of said electrode plates which is disposed at a location where the electric field strength of an undesired resonance mode of the dielectric resonator is greater than that in other locations.

11. A dielectric resonator as claimed in claim 10, wherein the element is part of the electrode plate which projects out of the periphery of the electrodeless portion.

12. A dielectric resonator as claimed in claim 10, wherein the element is part of the electrodeless portion which projects into the electrode plate.

13. A dielectric resonator as claimed in claim 10, wherein the electrodeless portion is substantially circular.

14. A dielectric resonator as claimed in claim 13, wherein a desired resonance mode is the $TE_{010}$ mode.

15. A dielectric resonator as claimed in claim 13, wherein the undesired resonance mode is the $HE_{310}$ mode.

16. A dielectric resonator as claimed in claim 10, wherein the electrodeless portion is nearly rectangular.

17. A dielectric resonator as claimed in claim 16, wherein a desired resonance mode is the $TE_{102}$ mode.

18. A directional resonator as claimed in claim 16, wherein the undesired resonance mode is the $TM_{111}$ mode or $TM_{112}$ mode.

19. A dielectric resonator as claimed in claim 10, wherein a plurality of said elements are disposed respectively at locations where the electric field strength of an undesired resonance mode is greater than in other locations.

20. A dielectric resonator as claimed in claim 10, wherein said element is arranged on said dielectric substrate.

* * * * *